US005079137A

United States Patent [19]

Taguchi et al.

[11] Patent Number: 5,079,137

[45] Date of Patent: Jan. 7, 1992

[54] HEAT-DEVELOPABLE COLOR PHOTOGRAPHIC LIGHT-SENSITIVE MATERIAL

[75] Inventors: Toshiki Taguchi; Takayuki Ito, both of Kanagawa, Japan

[73] Assignee: Fuji Photo Film Co., Ltd., Kanagawa, Japan

[21] Appl. No.: 561,551

[22] Filed: Aug. 1, 1990

[30] Foreign Application Priority Data

Aug. 1, 1989 [JP] Japan ..... 1-199645

[51] Int. Cl.[5] ..... G03C 5/54

[52] U.S. Cl. ..... 430/559; 430/203; 430/216; 430/219; 430/223; 430/551; 430/607; 430/617

[58] Field of Search ..... 430/203, 216, 219, 551, 430/607, 617, 559, 223

[56] References Cited

U.S. PATENT DOCUMENTS 4,555,476 11/1985 Sakaguchi et al. ..... 430/203
4,559,290 12/1985 Sawada et al. ..... 430/203
4,626,499 12/1986 Kato et al. ..... 430/203
4,783,396 11/1988 Nakamura et al. ..... 430/203

*Primary Examiner*—Richard L. Shilling
*Attorney, Agent, or Firm*—Sughrue, Mion, Zinn, Macpeak & Seas

[57] ABSTRACT

A heat-developable color photographic light-sensitive material capable of giving positive color images having high maximum density, low minimum density, and less strain, comprising at least a light-sensitive silver halide, a binder, a dye-providing non-diffusible compound capable of releasing a diffusible dye on being reduced, and a reducing agent, wherein the light-sensitive material further contains at least one compound represented by the following formula (I), (II), or (III);

(I)

n = 0 or 1

(II)

n = 0 or 1

(III)

n = 0 or 1 wherein $R^1$ and $R^2$ each represents a substituted or unsubstituted alkyl group, a substituted or unsubstituted aryl group, or a substituted or unsubstituted heterocyclic group, with a proviso that $R^1$ and $R^2$ each represents a group having no redox activity after its cleavage and $R^3$ and $R^4$ each represents a hydrogen atom, a halogen atom, a substituted or unsubstituted alkyl group, a substituted or unsubstituted aryl group, or a substituted or unsubstituted heterocyclic group.

12 Claims, No Drawings

HEAT-DEVELOPABLE COLOR PHOTOGRAPHIC LIGHT-SENSITIVE MATERIAL

FIELD OF THE INVENTION

This invention relates to a heat-developable color photographic light-sensitive material, and more particularly to a heat-developable color photographic light-sensitive material capable of giving positive color images having high maximum density, low minimum density and less stains

BACKGROUND OF THE INVENTION

Heat-developable light-sensitive materials are known in the field of art and heat-developable light-sensitive materials and processes for processing them are described, e.g., in *Shashin Kogaku no Kiso (The Basis or Photographic Engineering)*, "Non-Silver Salt Photography", pages 242 to 255, published by Corona Sha, (1982).

Also, various processes of obtaining color images by heat development have been proposed.

For example, a process of forming color images by the combination of the oxidation product of a developing agent and a coupler is described in U.S. Pat. Nos. 3,531,286, 3,761,270, and 4,021,240, Belgian Patent 802,519, and *Research Disclosure* (hereinafter referred to as RD), (September, 1975), pages 31 to 32.

However, since the aforesaid heat-developable light-sensitive material for obtaining color images is of a non-fixing type, silver halide remains therein after forming images, which causes a serious problem that when the color images are exposed to intense light or stored for a long period of time, the background is gradually colored. Furthermore, the aforesaid processed have disadvantages that the development requires generally a relatively long period of time and images obtained have high fog and a low image density.

For solving these problems, a process of imagewise forming or releasing diffusible dye(s) by heating and transferring the diffusible dye(s) onto an image-receiving material having a mordant by using water or other solvent is disclosed in U.S. Pat. Nos. 4,500,626, 4,483,914, 4,503,137, and 4,559,290 and JP-A-59-165054 ("JP-A" as used herein mean an "unexamined published Japanese patent application").

However, in the aforesaid process, the development temperature is high and the light-sensitive materials being employed are yet insufficient in storage stability.

Thus, a process of carrying out heat development in the existence of a base or a base precursor and a slight amount of water to form dye(s) and transferring the dye(s) thus formed, whereby the development is accelerated, the development temperature is reduced, and processing is simplified, is disclosed in JP-A-59-218443 and JP-A-61-238056 and European Patent 210,660A2.

Also, various processes obtaining positive color images by heat development are proposed.

For example, U.S. Pat. No. 4,559,290 discloses a process of using a so-called DRR compound which has been converted into an oxidized type compound having no faculty of releasing a dye and a reducing agent or a precursor therefor, oxidizing the reducing agent by heat development according to the exposed amount of silver halide and reducing the aforesaid compound with the reducing agent which remained without being oxidized to release a diffusible dye.

Also, EP-A-220746 and *Kokai Giho*, 87-6199 (Vol. 12, No. 22) describe heat-developable color photographic light-sensitive materials using a compound capable of releasing a diffusible dye by a reductive cleavage of an N-X bond (wherein X represents an oxygen atom, a nitrogen atom or a sulfur atom) as a compound capable of releasing a diffusible dye by the same mechanism as described above.

However, the aforesaid heat-developable color photographic light-sensitive materials giving positive color images are not in the level of commercially available color print materials in the stains, and tone reproducibility of color images formed.

SUMMARY OF THE INVENTION

The object of this invention is, therefore, to improve the discrimination, and tone reproducibility of a heat-developable color photographic light-sensitive material using reducible dye-providing compound(s).

It has now been discovered that the aforesaid object is attained by the present invention.

Thus, according to this invention, there is provided a heat-developable color photographic light-sensitive material comprising at least a light-sensitive silver halide, a binder, a dye-providing non-diffusible compound capable of releasing a diffusible dye on being reduced (hereinafter, the compound is referred to as a "reducible dye-providing compound"), and a reducing agent, wherein the light-sensitive material further contain at least one compound represented by following formula (I), (II), or (III);

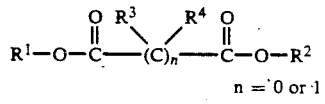

(I)

n = 0 or 1

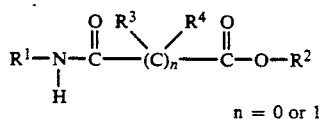

(II)

n = 0 or 1

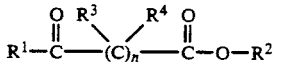

(III)

n = 0 or 1 wherein $R^1$ and $R^2$ each represents a substituted or unsubstituted alkyl group, a substituted or unsubstituted aryl group, or a substituted or unsubstituted heterocyclic group, with a proviso that $R^1$ and $R^2$ each represents a group having no redox activity after its cleavage and $R^3$ and $R^4$ each represents a hydrogen atom, a halogen atom, a substituted or unsubstituted alkyl group, a substituted or unsubstituted aryl group, or a substituted or unsubstituted heterocyclic group.

DETAILED DESCRIPTION OF THE INVENTION

Then, this invention is described in detail.

First, the aforesaid compounds shown by formulae (I), (II), and (III) are described in detail.

The compounds shown by aforesaid formulae (I), (II), and (III) are ester or amide derivatives of oxalic acid, malonic acid, substituted malonic acid, α-keto-acid, β-keto-acid, substituted α-keto-acid, or substituted β-keto-acid.

These compounds can be synthesized by generally known synthesis methods for esters and amides and details of these synthesis methods, which can be utilized for producing the aforesaid compounds, are described, e.g., in *Sin Jikken Kagaku Koza (New Experimental Chemistry Course)*, Vol. 14, "Synthesis and Reaction of Organic Compound [II]", page 1000, edited by Chemical Society of Japan, published by Maruzen K. K.

$R^1$ and $R^2$ in formulae (I) (II), and (III) each represents a substituted or unsubstituted alkyl group having preferably from 1 to 40 carbon atoms, more preferably from 1 to 20 carbon atoms (e.g., methyl, ethyl, propyl, i-propyl, n-butyl, i-butyl, t-butyl, n-hexyl, cyclohexyl, n-octyl, n-decyl, n-dodecyl, n-hexadecyl, 2-ethylhexyl, decalyl, benzyl, alkylbenzyl, alkoxybenzyl, hydroxyethyl, acyloxyethyl, and alkoxyethyl), a substituted or unsubstituted aryl group having preferably not more than 40 carbon atoms, more preferably not more than 20 carbon atoms (e.g., phenyl, tolyl, xylyl, cumyl, anisyl, nitrophenyl, sulfophenyl, alkoxyphenyl, chlorophenyl, and bromophenyl), or a substituted or unsubstituted heterocyclic group having preferably not more than 40 carbon atoms, more preferably not more than 20 carbon atoms (e.g., pyridyl, furyl, thiophenyl, imidazolyl, alkylpyridyl, and quinolyl).

Also, $R^3$ and $R^4$ each represents a hydrogen atom, a halogen atom (e.g., chlorine and bromine), a substituted or unsubstituted alkyl group, a substituted or unsubstituted aryl group, or a substituted or unsubstituted heterocyclic group, each group having preferably not more than 20 carbon atoms, more preferably not more than 8 carbon atoms and examples thereof being those as described above for $R^1$ and $R^2$.

When the compound shown by formula (I), (II), or (III) is incorporated in the light-sensitive material, the amount thereof is from 0.01 to 10 mole times, and preferably from 0.05 to 2 mole times the total amount of the reducing agent.

Also, the compound may exist in the light-sensitive layer(s), intermediate layer(s), or a protective layer of the light-sensitive material. The compound may exist in one layer or in two or more layers.

The compound shown by formula (I), (II), (III) is preferably used by coemulsifying a mixture of the compound with the same high-boiling organic solvent as that used in case of dispersing a reducible dye-providing compound and/or an electron donor in a hydrophilic binder as described below, together with the reducible dye-providing compound and/or the electron donor.

The compound shown by formula (I) or (II) is more preferably coemulsified with the reducible dye-providing compound and/or the electron donor.

Then, specific examples of the compounds shown by formulae (I), (II), and (III) are illustrated below.

ES-1

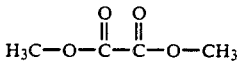

ES-2

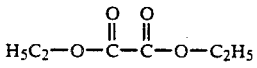

ES-3

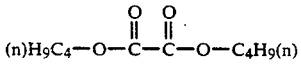

ES-4

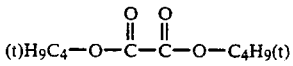

ES-5

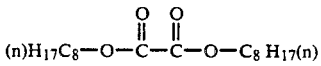

ES-6

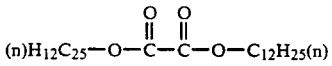

ES-7

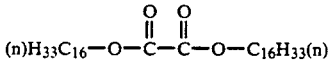

ES-8

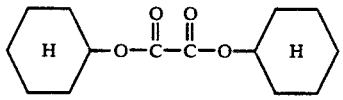

ES-9

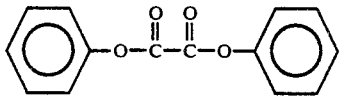

ES-10

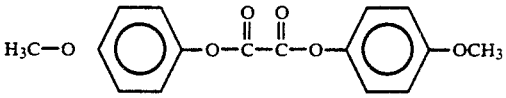

-continued
ES-11
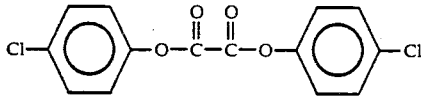
ES-12
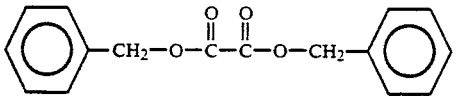
ES-13
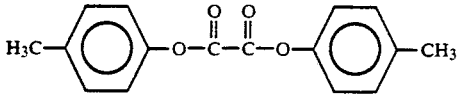
ES-14
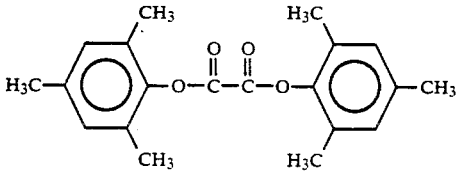
ES-15
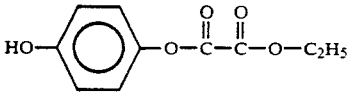
ES-16
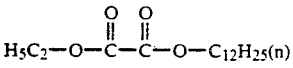
ES-17
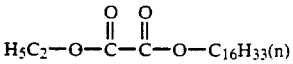
ES-18
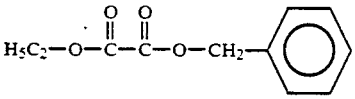
ES-19
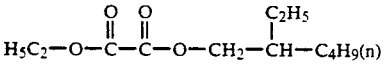
ES-20
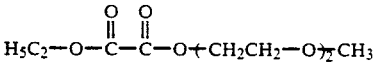
ES-21
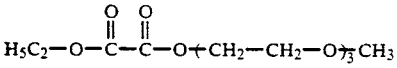
ES-22
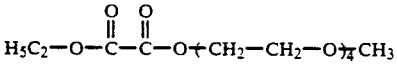
ES-23
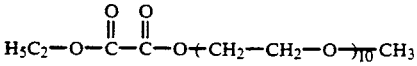
ES-24
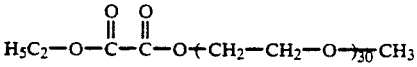
ES-25
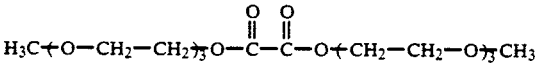
ES-26
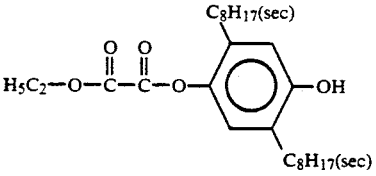

-continued
ES-27
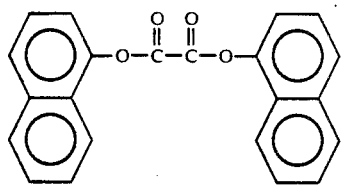
ES-28
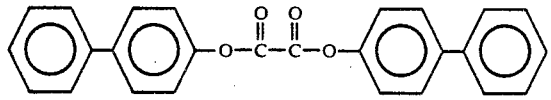
ES-29
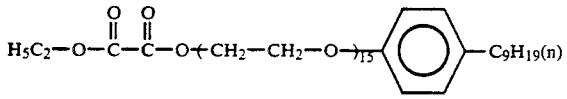
ES-30
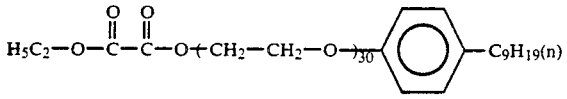
ES-31
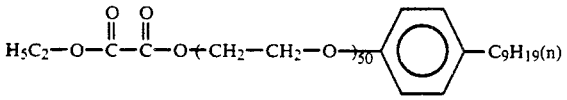
ES-32
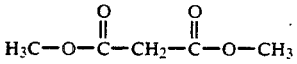
ES-33
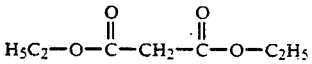
ES-34
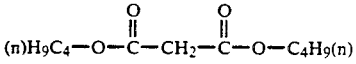
ES-35
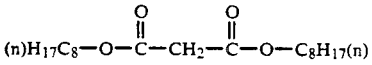
ES-36
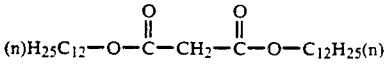
ES-37
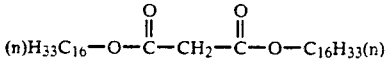
ES-38
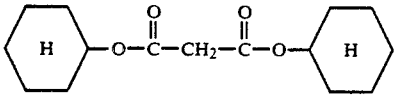
ES-39
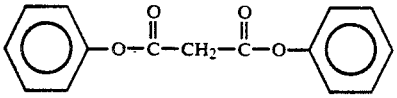
ES-40
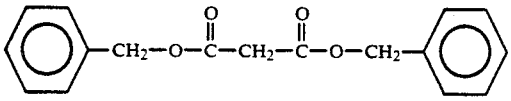
ES-41
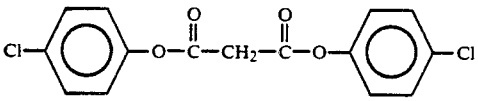

-continued
ES-42
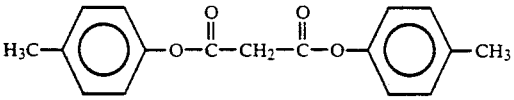
ES-43
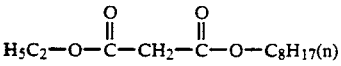
ES-44
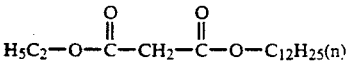
ES-45
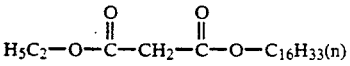
ES-46
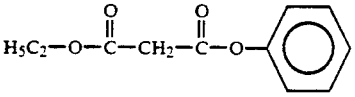
ES-47
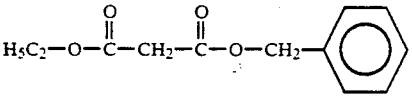
ES-48
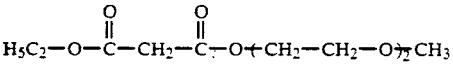
ES-49
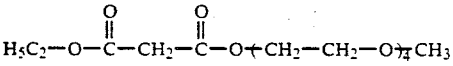
ES-50
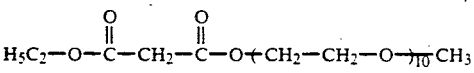
ES-51
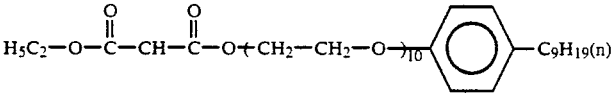
ES-52
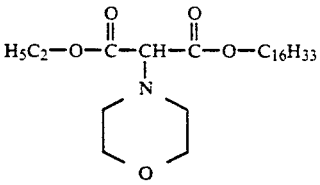
ES-53
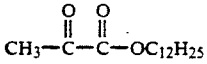
ES-54
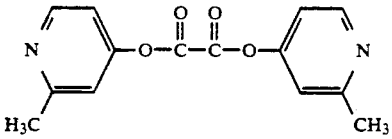
ES-55
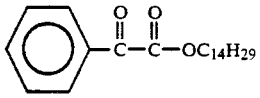

-continued
ES-56
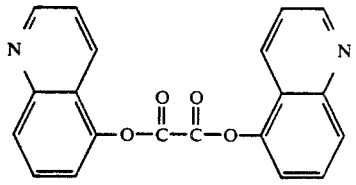
ES-57
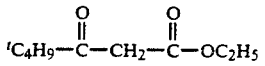
ES-58
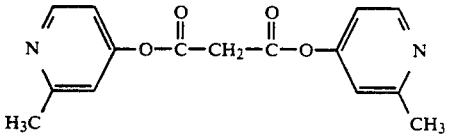
ES-59
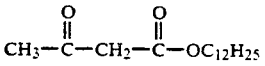
ES-60
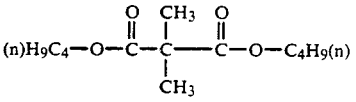
ES-61
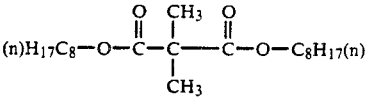
ES-62
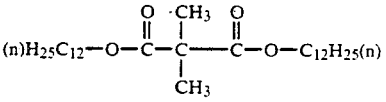
ES-63
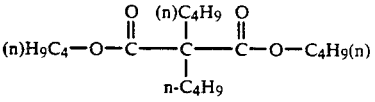
ES-64
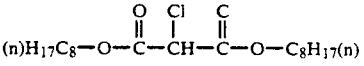
ES-65
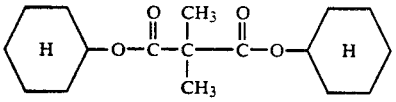
ES-66
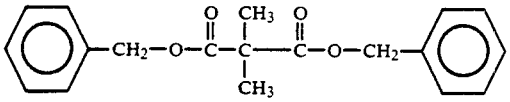
ES-67
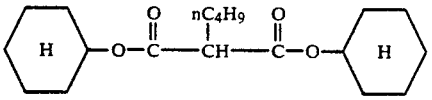
ES-68
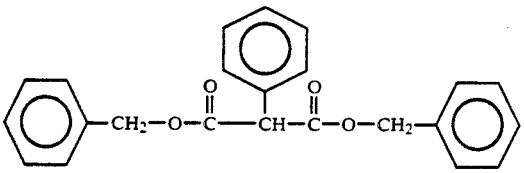

-continued
ES-69
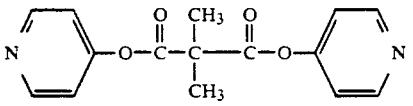
ES-70
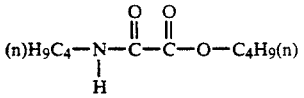
ES-71
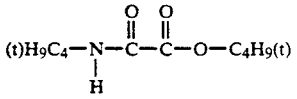
ES-72
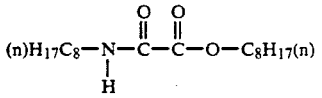
ES-73
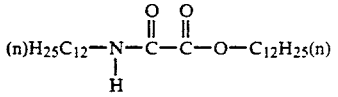
ES-74
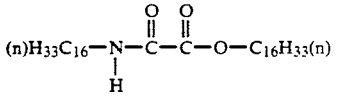
ES-75
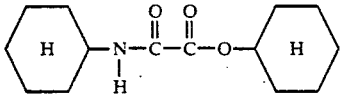
ES-76
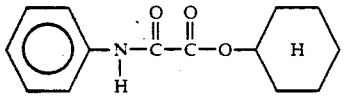
ES-77
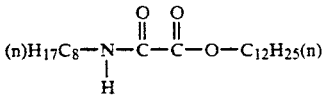
ES-78
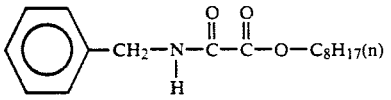
ES-79
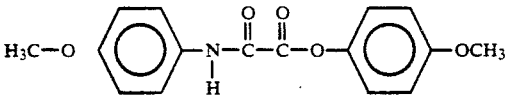
ES-80
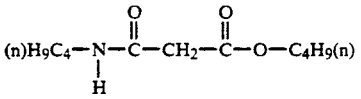
ES-81
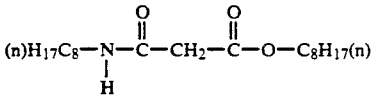
ES-82
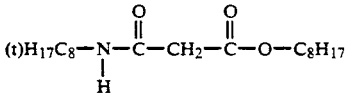

-continued

ES-83

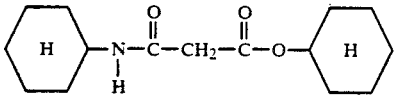

ES-84

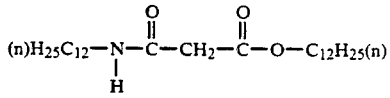

ES-85

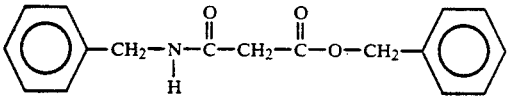

ES-86

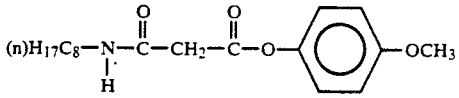

ES-87

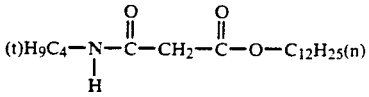

ES-88

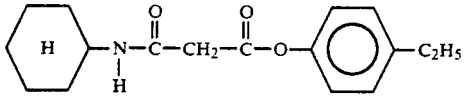

ES-89

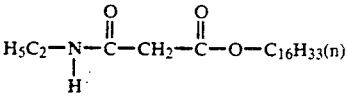

ES-90

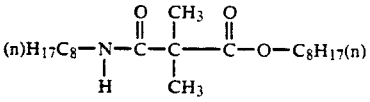

ES-91

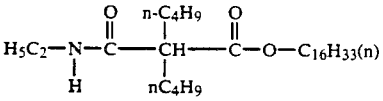

ES-92

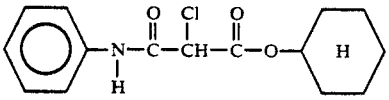

ES-93

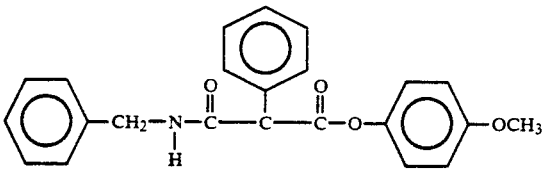

In this invention, one unit of light-sensitive layer is composed of a combination of the reducible dye-providing compound, an electron transfer agent, an electron donor, a binder, and a silver halide emulsion. The reducible dye-providing compound may exist in the layer of a silver halide emulsion but may exist in a layer adjacent to the silver halide emulsion layer. In the latter case, it is preferred in the point of sensitivity that the layer containing the reducible dye-providing compound is disposed under the silver halide emulsion layer. In this case, the electron transfer agent and the electron donor may exist in either the silver halide emulsion layer or the layer containing the reducible dye-providing compound.

In this invention, at least two sets of such light-sensitive layers are used. For reproducing full colors, three sets of light-sensitive layers each having a different color sensitivity are usually used. For example, a combination of a blue-sensitive layer, a green-sensitive layer, and a red-sensitive layer or a combination of a green-sensitive layer, a red-sensitive layer, and an infrared-sensitive layer is used. These light-sensitive layers can be disposed in various disposition orders as known from ordinary color photographic light-sensitive materials.

Also, if necessary, each light-sensitive layer may be composed of two or more layers.

Then, the reducible dye-providing compound being used in this invention is explained.

The reducible dye-providing compound being used in this invention is preferably a compound shown by the following formula (C-I)

$$\text{PWR—(Time)}_t\text{—Dye} \qquad \text{(C—I)}$$

wherein PWR represents a group releasing -(Time)$_t$ Dye by being reduced; Time represents a group releasing Dye through a subsequent reaction after being released from PWR as -(Time)$_t$Dye; t represents 0 or 1; and Dye represents a dye or a precursor thereof.

First, PWR is explained in detail.

PWR may be one corresponding to a moiety containing the electron acceptive center and the intramolecular nucleophilic substitution reaction center in a compound capable of releasing a photographic reagent by an intramolecular nucleophilic substitution reaction after being reduced as disclosed in U.S. Pat. Nos. 4,139,389, 4,139,379, and 4,564,577, JP-A-59-185333 and JP-A-57-84453, or may be one corresponding to a moiety containing the electron acceptive quinoid center and the carbon atom bonding the quinoid center to a photographic reagent in a compound capable of releasing the photographic reagent by an intramolecular electron transfer reaction after being reduced as disclosed in U.S. Pat. Nos. 4,232,107, JP-A-59-101649 and JP-A-61-88257, RD, No. 24025, IV, (1984).

Also, PWR may be one corresponding to a moiety containing the aryl group substituted by an electron attractive group and the atom (a sulfur atom, a carbon atom, or a nitrogen atom) bonding the aryl group to a photographic reagent in a compound capable of releasing the photographic reagent by the cleavage of a single bond after being reduced as disclosed in JP-A-56-142530 and U.S. Pat. Nos. 4,343,893 and 4,619,884, it may be one corresponding to a moiety containing the nitro group and the carbon atom bonding the nitro group to a photographic reagent in a nitro compound capable of releasing the photographic reagent after receiving electron as disclosed in U.S. Pat. No. 4,450,223, or it may be one corresponding to a moiety containing the geminaldinitro moiety and the carbon atom bonding the dinitro moeity to a photographic reagent in a dinitro compound capable of releasing the photographic reagent by a $\beta$-elimination reaction after receiving an electron as disclosed in U.S. Pat. No. 4,609,610.

Furthermore, as PWR, there may be a compound having $SO_2$—X (wherein X represents oxygen, sulfur or nitrogen) and an electron attractive group in the molecule as disclosed in U.S. Pat. No. 4,840,887 and JP-A-62-106885, a compound having PO-X (wherein X has the same significance as above) and an electron attractive group in the molecule as disclosed in Japanese Patent Application No. 62-106895 (corresponding to JP-A-63-271344) and a compound having C—X' (wherein X' represents oxygen, sulfur, nitrogen, or —$SO_2$—) and an electron attractive group in the molecule as disclosed in Japanese Patent Application No. 62-106887 (corresponding to JP-A-63-271341).

In the compounds shown by the aforesaid formula (C-I), the compound shown by following formula (C-II) is preferred for sufficiently attaining the object of this invention.

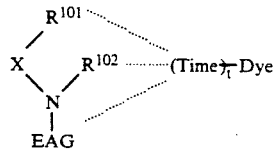

(C-II)

Time)$_t$Dye is bonded to at least one of $R^{101}$, $R^{102}$, and EAG.

Then, the moiety corresponding to PWR of the compound shown by (C-II) is explained.

X represents an oxygen atom (—O—), a sulfur atom (—S—), or a nitrogen-containing group (—N($R^{103}$)—).

$R^{101}$, $R^{102}$, and $R^{103}$ each represents a group other group than hydrogen atom or a simple bond.

As the group other than hydrogen atom shown by $R^{101}$, $R^{102}$, and $R^{103}$, there are an alkyl group, an aralkyl group, an alkenyl group, an alkinyl group, an aryl group, a heterocyclic group, a sulfonyl group, a carbamoyl group, a sulfamoyl group, etc., and these groups may have a substituent.

$R^{101}$ and $R^{103}$ each is preferably an alkyl group, an alkenyl group, an alkinyl group, an aryl group, a heterocyclic group, an acyl group, or a sulfonyl group each of which may be substituted or unsubstituted. Also, the carbon atom number of each group shown by $R^{101}$ and $R^{103}$ is preferably not more than 40.

$R^{102}$ is preferably a substituted or unsubstituted acyl group or a substituted or unsubstituted sulfonyl group. The carbon number of the group shown by $R^{102}$ is preferably not more than 40.

Furthermore, $R^{101}$, $R^{102}$ and $R^{103}$ may combined with each other to form a 5- to 8-membered ring.

X is particularly preferably oxygen.

EAG will be described later.

Furthermore, in the compounds shown by the aforesaid formula (C-II), the compounds shown by following formula (C-III) are preferred for attaining the object of this invention.

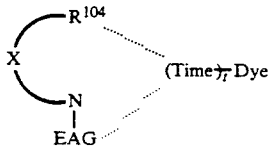

(C-III)

(Time)$_t$Dye is bonded to at least one of $R^{104}$ and EAG.

X has the same meaning as above.

$R^{104}$ represents an atomic group forming a 5- to 7-membered monocyclic or condensed heterocyclic ring containing the nitrogen atom by combining with X and the nitrogen atom.

EAG represents a group capable of accepting an electron from a reducing substance and is bonded to the nitrogen atom. EAG is preferably a group shown by the following formula (A);

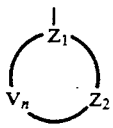

(A)

wherein $Z_1$ represents

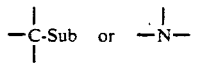

and $V_n$ represents an atomic group forming a 3- to 8-membered aromatic group and n represents an integer of from 3 to 8.

Thus, $V_3$ is $-Z_3-$, $V_4$ is $-Z_3-Z_4-$, $V_5$ is $-Z_3-Z_4-Z_5-$, $V_6$ is $-Z_3-Z_4-Z_5-Z_6-$, $V_7$ is $-Z_3-Z_4-Z_5-Z_6-Z_7-$, and $V_8$ is $-Z_3-Z_4-Z_5-Z_6-Z_7-Z_8-$.

In the above formulae, $Z_2$ to $Z_8$ each is

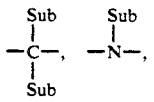

—O—, —S—, or $-SO_2-$ (wherein Sub represents a simple bond ($\pi$-bond), a hydrogen atom or the substituent shown below. The Sub(s) may be the same or different, and may combine with each other to form a 3- to 8-membered saturated or unsaturated carbon ring or heterocyclic ring.

In the formula (A), Sub(s) are selected such that the total sum of the Hammett's substituent constants $\sigma$-para of the substituents is preferably at least +0.50, more preferably at least +0.70, and most preferably at least +0.85.

EAG is preferably an aryl or heterocyclic group substituted by at least one electron attractive group. The substituents bonded to the aryl group or the heterocyclic group of EAG can be utilized for controlling the properties of the whole compound. Examples of the properties of the whole compound are the acceptability of electron as well as the water-solubility, the oil-solubility, the diffusibility, the sublimability, the melting point, the dispersibility for a binder such as gelatin, etc., the reactivity for a nucleophilic group, and the reactivity for an electrophilic group.

Practical examples of EAG are described in EP-A-220746, pages 6 to 7 and U.S. Pat. No. 4,783,396, columns 3 to 6.

Time represents a group capable of releasing Dye via the subsequent reaction by the cleavage of a nitrogen-oxygen bond, a nitrogen-nitrogen bond, or a nitrogen-sulfur bond with a trigger.

The groups shown by Time are known, as described in JP-A-61-147244, pages 5 and 6, JP-A-61-236549, pages 8 to 14, Japanese Patent Application No. 61-88625 (corresponding to JP-A-62-215270), pages 36 to 44 and U.S. Pat. No. 4,783,396, columns 8 to 19.

The dyes shown by Dye include azo dyes, azomethine dyes, anthraquinone dyes, naphthoquinone dyes, styryl dyes, nitro dyes, quinoline dyes, carbonyl dyes, phthalocyanine dyes, etc. In addition, these dyes can be used in the form of being temporarily shifted to a shorter wavelength side, which can be recolored at development.

Practically, the dyes disclosed in EP-A-76492 and JP-A-59-165054 can be utilize.. It is necessary that the compound shown by the aforesaid formula (C-II) or (C III) is immobile in a photographic layer and for the purpose it is preferred that the compound has a ballast group having 8 or more carbon atoms at the position of EAG, $R^{101}$, $R^{102}$, $R^{104}$, or X (in particular, at the position of EAG).

Then, typical examples of the reducible dye-providing compound for use in this invention are illustrated below but this invention is not limited to these compounds and, for example, the dye-providing compounds described in EP-A-220746 and *Kookai Giho,* 87-6199 can be also used in this invention.

Dye-providing Compound (1)

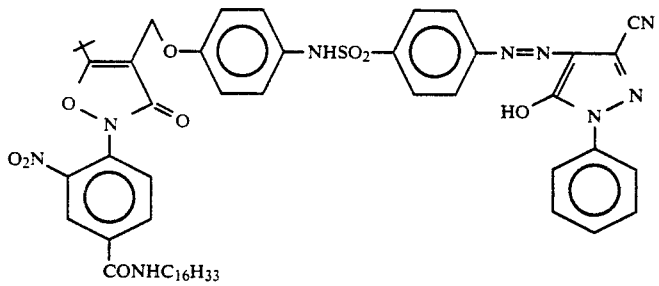

(2)

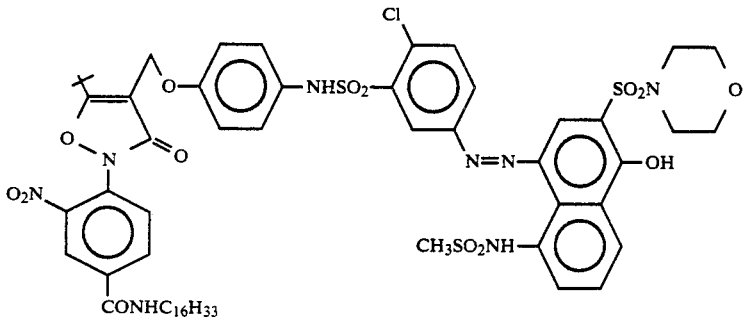

-continued
Dye-providing Compound
(3)
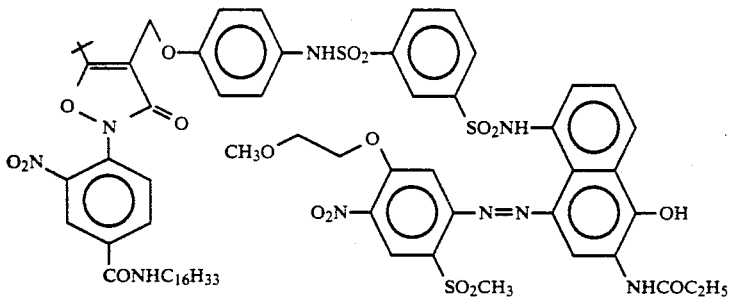
(4)
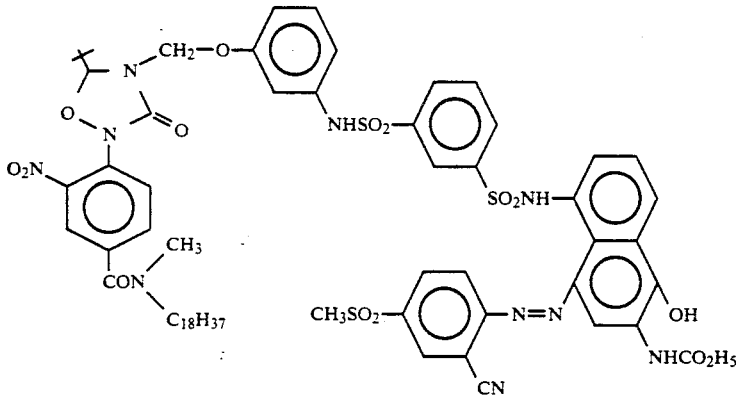
(5)
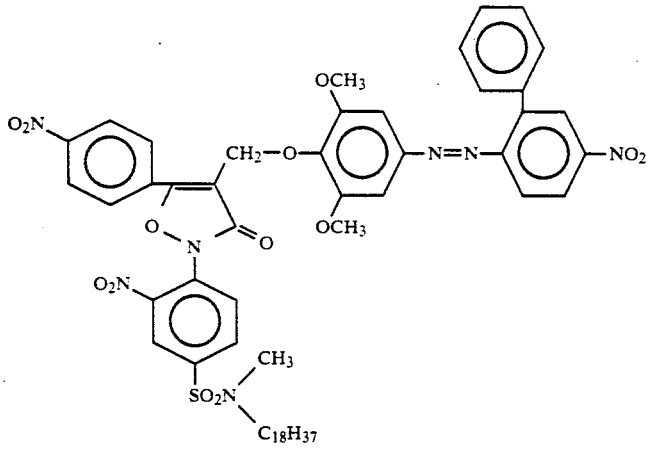
(6)
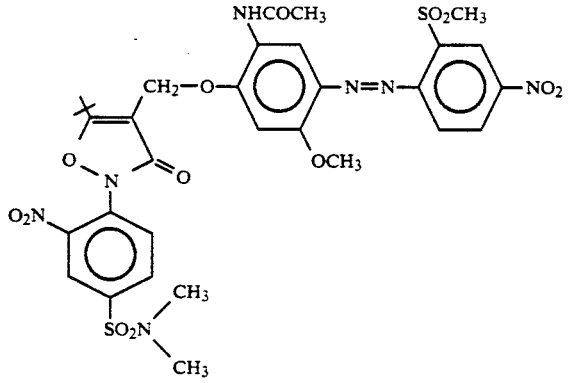

-continued
Dye-providing Compound
(7)
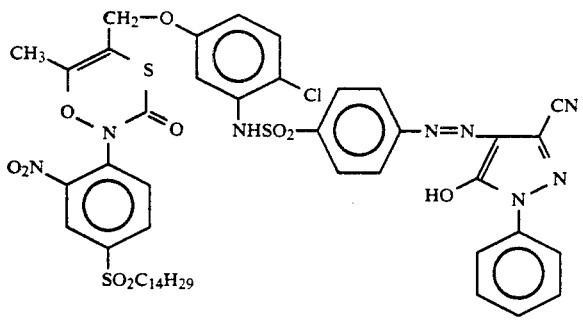
(8)
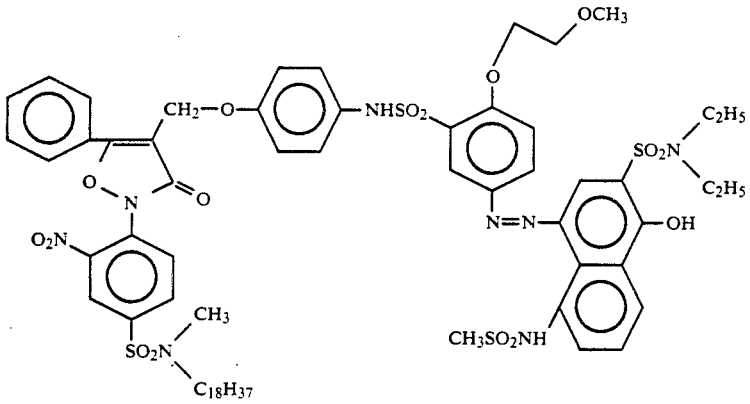
(9)
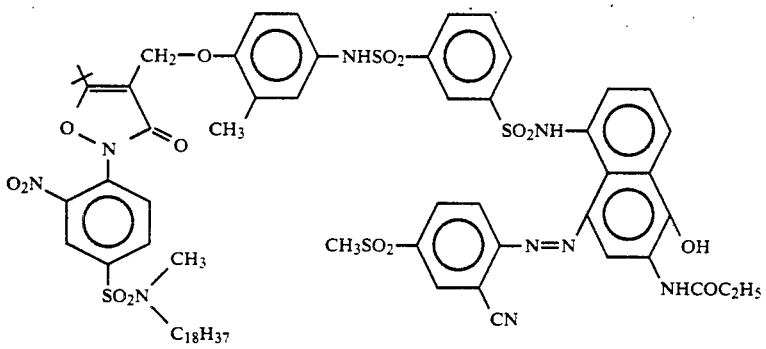
(10)
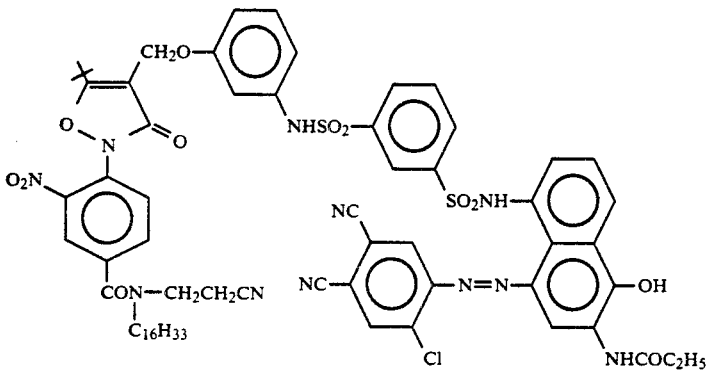

-continued
Dye-providing Compound
(11)
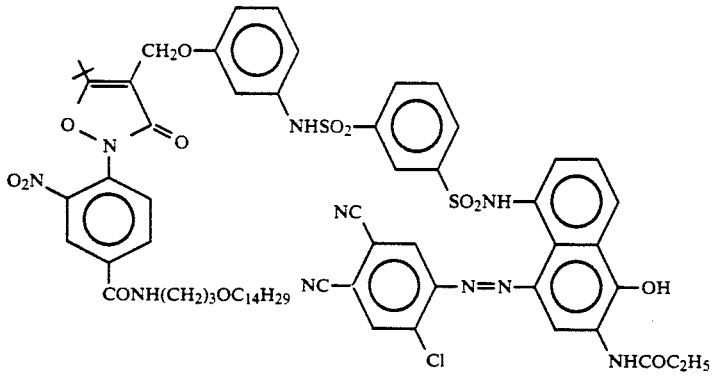
(12)
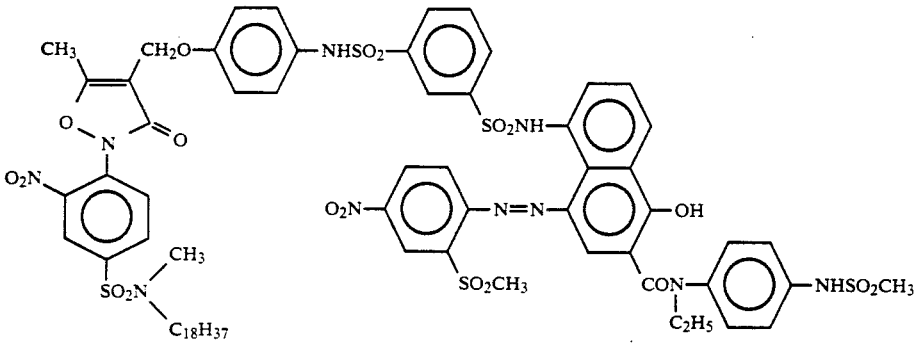
(13)
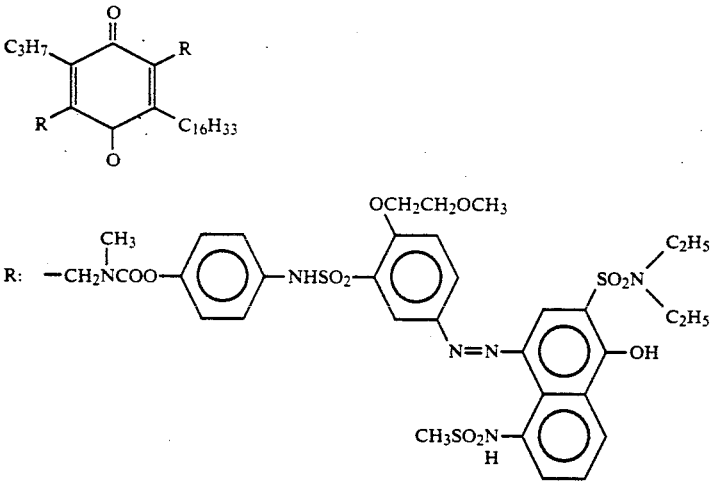
(14)
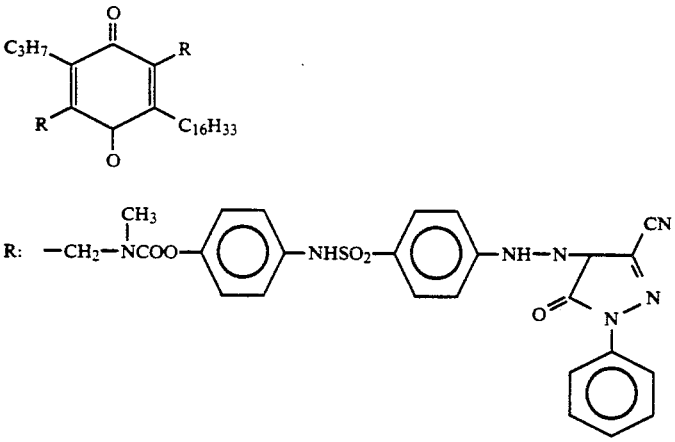

-continued

Dye-providing Compound (15)

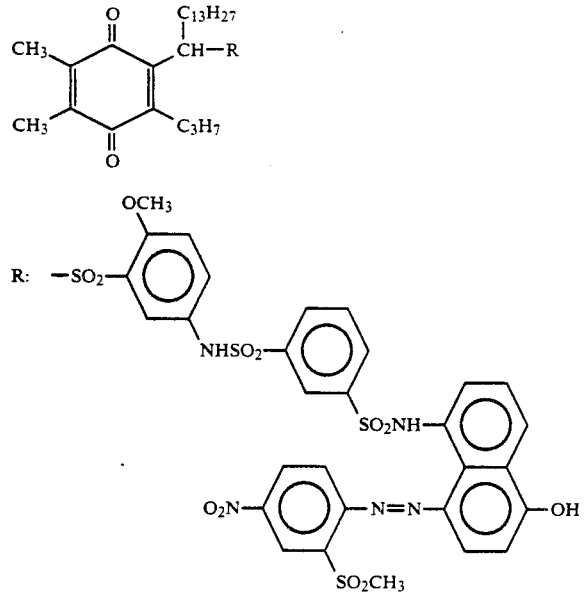

(16)

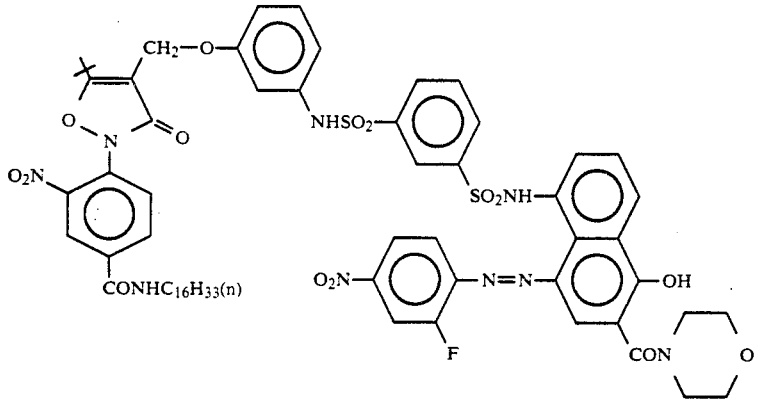

(17)

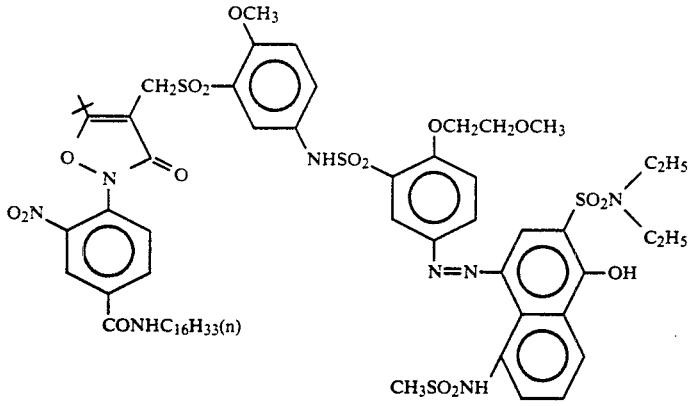

These compounds can be synthesized by the methods described in the aforesaid patent specifications.

The amount of the dye-providing compound depends upon the extinction coefficient of the dye but is usually from 0.05 to 5 mmoles/$m^2$, and preferably from 0 1 to 3 mmoles/$m^2$. The dye-providing compounds can be used singly or as a combination thereof.

Also, for obtaining black images or images composed of different colors, two or more kinds of dye-providing compounds each releasing a mobile dye each having a different color can be used as a mixture thereof in such a manner that a mixture of, for example, at least one kind of a cyan dye-providing compound, at least one kind of a magenta dye-providing compound, and at least one kind of a yellow dye-providing compound is incorporated in a layer containing silver halide or a layer adjacent to the silver halide-containing layer as described in JP-A-60-162251.

In this invention, it is preferred to use a non-diffusible reducing agent together with a mobile reducing agent. In this case, an electron donor and an electron transfer agent (ETA) are used and details of these compounds are described in EP-A-220746 and *Kookai Giho,* No. 87-6199.

Particularly preferred electron donors (and the precursors thereof) are the compounds represented by following formula (C) or (D).

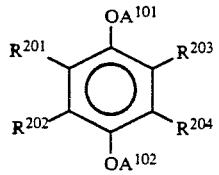

(C)

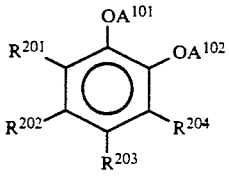

(D)

In the above formulae, $A^{101}$ and $A^{102}$ each represents a hydrogen atom or a protective group for a phenolic hydroxy group, said protective group being releasable by a nucleophilic reagent.

In this case, as the nucleophilic reagent, there are anionic reagents such as $OH^{\ominus}$, $RO^{\ominus}$ (wherein R represents an alkyl group or an aryl group), hydroxamic acid anions, $SO_3^{2\ominus}$, etc., and compounds having a non-covalent electron pair, such as primary or secondary amines, hydrazines, hydroxylamines, alcohols, thiols, etc.

Preferred examples of $A^{101}$ and $A^{102}$ are a hydrogen atom, an acyl group, an alkylsulfonyl group, an arylsulfonyl group, an alkoxycarbonyl group, an aryloxycarbonyl group, a dialkylphosphoryl group, a diarylphosphoryl group, and the protective groups disclosed in JP-A-59-197037 and JP-A-59-20105. Also, if possible, $A^{101}$ and $A^{102}$ may combine with $R^{201}$, $R^{202}$, $R^{203}$ and $R^{204}$ to form a ring. Furthermore, $A^{101}$ and $A^{102}$ may be the same or different.

In the aforesaid formulae, $R^{201}$, $R^{202}$, $R^{203}$ and $R^{204}$ each represents a hydrogen atom, an alkyl group, an aryl group, an alkylthio group, an arylthio group, a sulfonyl group, a sulfo group, a halogen atom, a cyano group, a carbamoyl group, a sulfamoyl group, an amido group, an imido group, a carboxy group, a sulfonamido group, etc. These groups may, if possible, have a substituent.

In addition, the sum of the carbon atoms of the groups shown by $R^{201}$, $R^{202}$, $R^{203}$, and $R^{204}$ is at least 8. Also, in formula (C), $R^{201}$ and $R^{202}$ and/or $R^{203}$ and $R^{204}$ may combine with each other to form a saturated or unsaturated ring and in formula (D), $R^{201}$ and $R^{202}$, $R^{202}$ and $R^{203}$, and/or $R^{203}$ and $R^{204}$ may combine with each other to form a saturated or unsaturated ring.

In the electron donors shown by the foresaid formula (C) or (D), it is preferred that at least two of $R^{201}$ to $R^{204}$ are Substituents (groups) other than hydrogen atom. In the particularly preferred compounds, at least one of $R^{201}$ and $R^{202}$ and at least one of $R^{203}$ and $R^{204}$ are substituents other than hydrogen atom.

The electron donors may be used as a combination thereof or the electron donor may be used together with the precursor of it. Also, the electron donor may be the same compound as the reducing substances for use in this invention.

The electron donor and/or precursor thereof are preferably used as a reducing agent.

Then, specific examples of the electron donors for use in this invention are illustrated below but the invention is not limited to them.

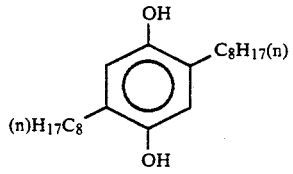

(ED-1)

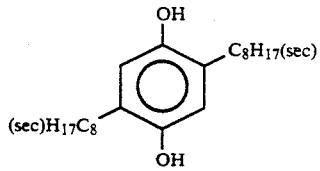

(ED-2)

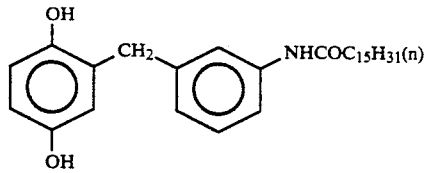

(ED-3)

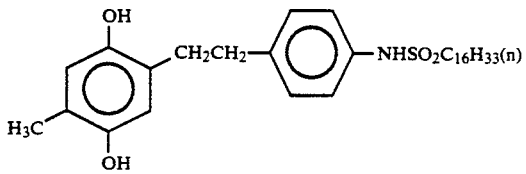

(ED-4)

-continued
(ED-5)
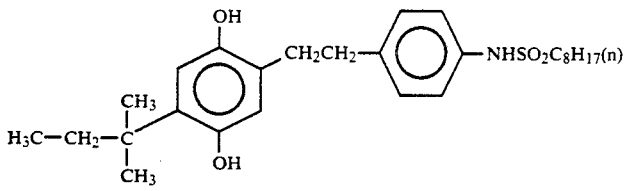
(ED-6)
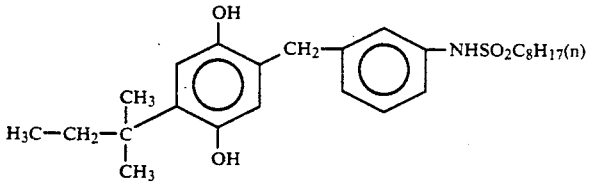
(ED-7)
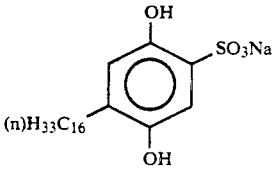
(ED-8)
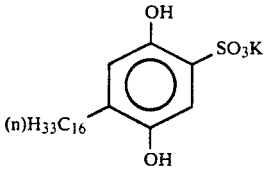
(ED-9)
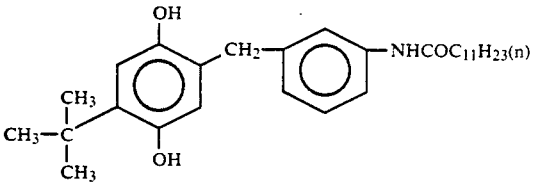
(ED-10)
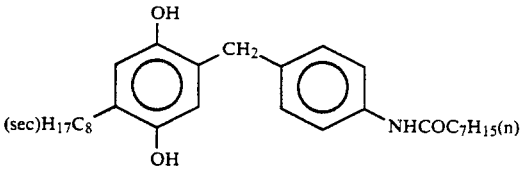
(ED-11)
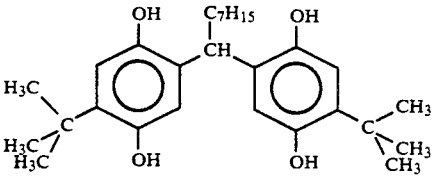
(ED-12)
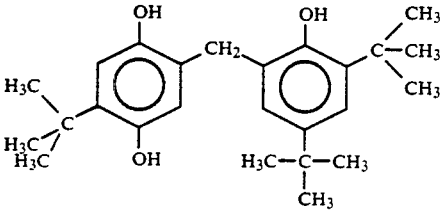

-continued (ED-13)

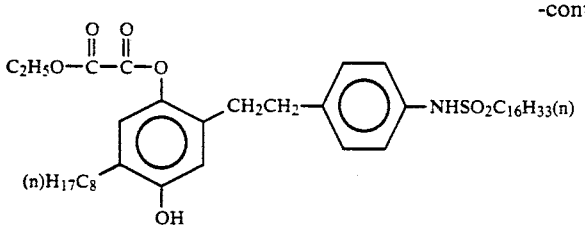

(ED-14)

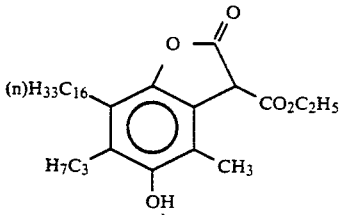

The electron donor (or the precursor thereof) can be used in a wide amount range but is preferably in the range of from 0.01 to 50 moles, and more preferably from 0.1 to 5 moles per mole of the positive dye-providing compound. Also, the amount thereof is from 0.001 to 5 moles and preferably from 0.01 to 1.5 moles per mole of silver halide.

As ETA which is used in combination with the aforesaid electron donor, any compounds which are oxidized by silver halide and the oxidation products of which have a faculty of cross-oxidizing the aforesaid electron donor, can be used but the compound is preferably mobile.

Particularly preferred examples of ETA are the compounds represented by following formula (X-I) or (X-II).

(X-I)

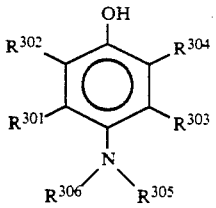

(X-II)

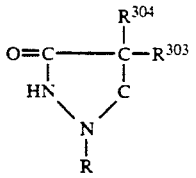

wherein R represents an aryl group and $R^{301}$, $R^{302}$, $R^{303}$, $R^{304}$, $R^{305}$, and $R^{306}$, which may be the same or different, each represents a hydrogen atom, a halogen atom, an acylamino group, an alkoxy group, an alkylthio group, an alkyl group, or an aryl group, each of which may be substituted.

In this invention, the compound shown by formula (X-II) is particularly preferred.

In formula (X-II), $R^{301}$, $R^{302}$, $R^{303}$, and $R^{304}$ each is preferably a hydrogen atom, an alkyl group having from 1 to 10 carbon atoms, a substituted alkyl group having from 1 to 10 carbon atoms, or a substituted or unsubstituted aryl group, and each is more preferably a hydrogen atom, a methyl group, a hydroxymethyl group, a phenyl group or a phenyl group substituted by a hydroxy group, an alkoxy group, a sulfo group, a carboxy group, etc.

Then, specific examples of ETA are shown below.

(X-1)

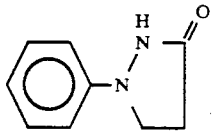

(X-2)

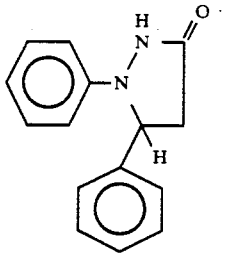

(X-3)

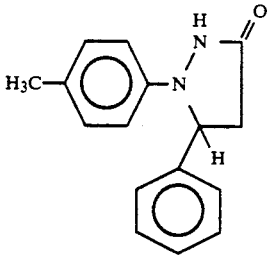

(X-4)

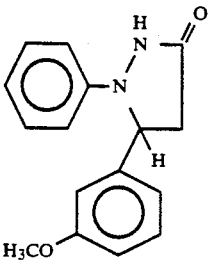

-continued (X-5)

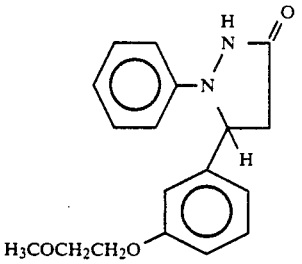

(X-6)

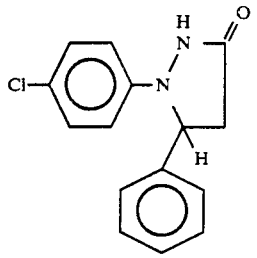

(X-7)

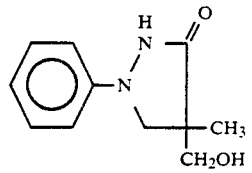

(X-8)

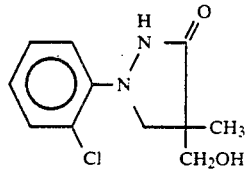

(X-9)

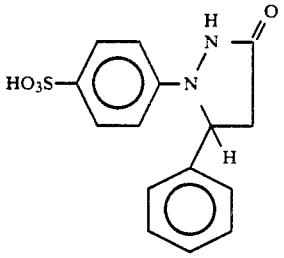

(X-10)

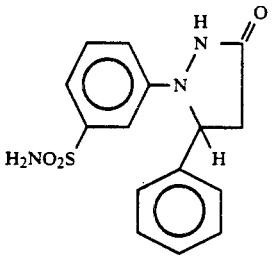

(X-11)

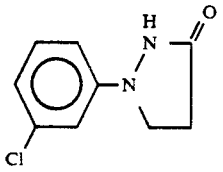

-continued (X-12)

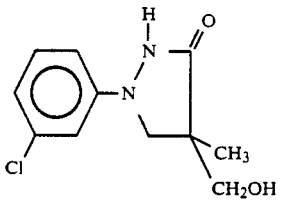

(X-13)

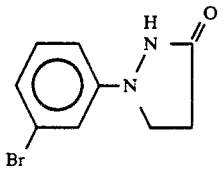

(X-14)

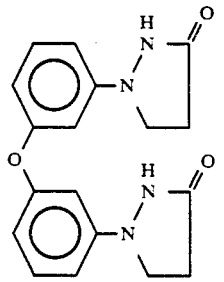

(X-15)

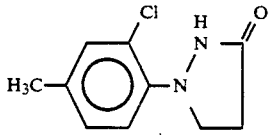

(X-16)

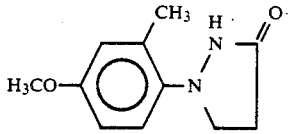

(X-17)

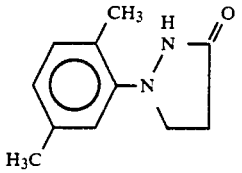

The ETA precursor for use in this invention is a compound which does not have a developing action during the preservation of the light-sensitive material before use but releases first ETA by the action of a proper activator (e.g., a base, a nucleophilic agent, etc.) or the action of heat, etc.

In particular, the ETA precursor for use in this invention does not have a function as ETA before development since the reaction functional group of ETA is blocked by a blocking group but functions as ETA under an alkaline condition or by heating since in this case, the blocking group is cleaved.

As the ETA precursor for use in this invention, there are 1-phenyl-3-pyrazolidinone-2-acyl derivatives, 1-phenyl-3-pyrazolidinone-3-acyl derivatives, 2-aminoalkyl derivatives, 2-aminohydroxyalkyl derivatives, metal salts (lead salts, cadmium salts, calcium salts, barium salts, etc.) of hydroquinone, catechol, etc., halogenated acyl derivatives of hydroquinone, oxazine or bisoxazine derivatives of hydroquinone, lactone-type ETA precursors, hydroquinone precursors having a quaternary ammonium group, cyclohex-2-ene-1,4-dione type compounds, compounds releasing ETA by an electron transfer reaction, compounds releasing ETA by an intramolecular nucleophilic substitution reaction, ETA precursors blocked by a phthalide group, and ETA precursors blocked by an indomethyl group.

The ETA precursors for use in this invention are known compounds such as the developer precursors described in U.S. Pat. Nos. 3,767,704, 3,241,967, 3,246,988, 3,295,978, 3,462,266, 3,586,506, 3,615,439, 3,650,749, 4,209,580, 4,330,617, and 4,310,612, British Patents 1,023,701, 1,231,830, 1,258,924, and 1,346,920, JP-A-57-40245, JP-A-58-1139, JP-A-58-1140, JP-A-59-178458, JP-A-59-182449 and JP-A-59-182450.

In particular, the precursors of 1-phenyl-3-pyrasolidinones described in JP-A-59-178458, JP-A-59-182449, and JP-A-59-182450 are preferred.

ETA can be used together with the ETA precursor.

In this invention the combination of the electron dodonor and ETA is preferably incorporated in the heat-developable color photographic light-sensitive material.

Also, the electron donors, ETA(s), and the precursors of them each can be used as a combination of two or more kinds thereof and they can be added to each of the emulsion layers (a blue-sensitive emulsion layer, a green-sensitive emulsion layer, a red-sensitive emulsion layer, an infrared-sensitive emulsion layer, an ultraviolet-sensitive emulsion layer, etc.) of the light-sensitive material, may be added to specific emulsion layers only, may be added to a layer adjacent to an emulsion layer (an antihalation layer, a subbing layer, an interlayer, a protective layer, etc.), or may be added to all the layers.

The electron donor and ETA or the ETA precursor can be added to a same layer or can be added separately to separate layers. Also, the reducing agent and the dye-providing compound may be added to a same layer or separate layers but it is preferred that the non-diffusible electron donor exists in the layer containing the dye-providing compound.

ETA can be incorporated in an image-receiving material (dye-fixing layer) and when a slight amount of water exists at heat development, ETA may be dissolved in the water.

The preferred amounts of the electron donor and ETA or the precursors of them are, as the total amounts, from 0.01 to 50 moles, and preferably from 0.1 to 5 moles per mole of the dye-providing compound, and also from 0.001 to 5 moles, and preferably from 0.01 to 1.5 moles, per mole of silver halide.

Also, the amount of ETA is not more than 60 mole%, and more preferably not more than 40 mole% of the whole reducing agent. When ETA is supplied as a solution dissolved in water during processing, the concentration of ETA is preferably from $10^{-4}$ mole/liter to 1 mole/liter.

For introducing the reducing substance, the dye-providing compound, the electron donor, the electron transfer agent, the precursors of them, and other hydrophobic additives to a hydrophilic colloid layer, a high-boiling organic solvent may be used.

Examples of the high-boiling organic solvent are phthalic acid alkyl esters (e.g., dibutyl phthalate and dioctyl phthalate), phosphoric acid esters (e.g., diphenyl phosphate, triphenyl phosphate, tricyclohexyl phosphate, tricresyl phosphate, and dioctylbutyl phosphate), citric acid esters (e.g., tributyl acetyl-citrate), benzoic acid esters (e.g., octyl benzoate), alkylamides (e.g., diethyllaurylamide), fatty acid esters (e.g., dibutoxy succinate and dioctyl azerate), trimesinic acid esters (e.g., tributyl trimesinate), the carboxylic acids described in Japanese Patent Application No. 61-231500 (corresponding to JP-A-63-85633), and the compounds described in JP-A-59-83154, JP-A-59-178451, JP-A-59-178452, JP-A-59-178453, JP-A-59-178454, JP-A-59-178455 and JP-A-59 178457.

Also, in these cases, the method described in U.S. Pat. No. 2,322,027 may be employed, or the aforesaid materials may be added to the aqueous hydrophilic colloid solution as a solution in a low-boiling organic solvent having a boiling point of from about 30° C to about 160° C. Examples of the low-boiling solvent are lower alkyl acetates (e.g., ethyl acetate and butyl acetate), ethyl propionate, secondary butyl alcohol, methyl isobutyl ketone, β-ethoxy ethyl acetate, methylcellosolve acetate, and cyclohexanone.

Furthermore, a mixture of the aforesaid high-boiling organic solvent and the low-boiling organic solvent can be used. Moreover, after dispersing the organic solution of the aforesaid materials in an aqueous hydrophilic colloid solution, if necessary, the low-boiling organic solvent may be removed by ultra-filtration, etc.

The amount of the high-boiling organic solvent being used in the aforesaid case is not more than 10 g, and preferably not more than 5 g per gram of the dye-providing compound being used. Also, the amount thereof is not more than 5 g, and preferably not more than 2 g per gram of the non-diffusible reducing agent and further the amount thereof is not more than 1 g, preferably not more than 0.5 g, and more preferably not more than 0.3 g per gram of the binder.

Also, the dispersion method by a polymer described in JP-B-51-39853 (the term "JP-B" as used herein means an "unexamined published Japanese patent application") and JP-A-51-59943 can be used.

In other methods, the aforesaid materials may be directly dispersed in an emulsion, or after dissolving them in water or an alcohol the solution may be dispersed in an aqueous gelatin solution or an emulsion.

When the compounds are substantially insoluble in water, the compounds can be dispersed in a binder as fine particles in addition to the aforesaid methods as described, e.g., in JP-A-59-174830, JP-A-53-102733 and Japanese Patent Application 62-106882 (corresponding to JP-A-63-271339).

In the case of dispersing hydrophobic substance in an aqueous hydrophilic colloid solution, various kinds of surface active agents can be used and examples of these surface active agents are described in JP-A-59-157636, pages 37 and 38.

The heat-developable light-sensitive material has fundamentally a light-sensitive silver halide, a binder, a reducing agent, and a reducible dye-providing compound on a support and further, if possible, the light-sensitive material can contain an organic metal salt oxidizing agent.

These components ordinary exist in the same layer but in the case that some components are reactive with each other, they may exist in separate layers. For example, when the colored dye-providing compound exists in a layer under a silver halide emulsion layer, the reduction of the sensitivity of the silver halide emulsion layer can be prevented. Also, the reducing agent is preferably incorporated in the heat-developable light-sensitive material but may be supplied from outside of the light-sensitive material, e.g., by a method that the reducing agent is diffused into the light-sensitive material from a dye-fixing material as will be described below.

For obtaining colors of wide ranges in the chromaticity diagram by using three primary colors of yellow, magenta, and cyan, a combination of at least three silver halide emulsion layers each having a light sensitivity in each different spectral region may be used. For example, there may be a combination of a blue-sensitive emulsion layer, a green-sensitive emulsion layer, and a red-sensitive emulsion layer; a combination of a green-sensitive emulsion layer, a red-sensitive emulsion layer, and an infrared-sensitive emulsion layer; etc. The light-sensitive emulsion layers can be disposed in the disposition order usually employed for ordinary-type color photographic light-sensitive materials. Also, each light-sensitive layer may be, if desired, composed of two or more layers.

The heat-developable light-sensitive material of this invention can have various subsidiary layers such as a protective layer, a subbing layer, an interlayer, a yellow filter layer, an antihalation layer, a back layer, etc.

As the silver halide being used in this invention, there are mentioned silver chloride, silver bromide, silver iodobromide, silver chlorobromide, silver chloroiodide, and silver chloroiodobromide.

The silver halide emulsion for use in this invention may be of a surface latent image type or an internal latent image type. The internal latent image type silver halide emulsion is used as a direct reversal silver halide emulsion by combining with a nucleating agent or a light fogging process.

Also, a so-called core/shell type silver halide emulsion wherein the inside of the silver halide grain has a different composition than that of the surface of the silver halide grain may be used.

Furthermore, the silver halide emulsion may be a monodisperse silver halide emulsion, a polydisperse silver halide emulsion, or a mixture of monodisperse silver halide emulsions.

The grain sizes of the silver halide grains for use in this invention are preferably from 0.1 to 2 μm, and particularly preferably from 0.2 to 1.5 μm. Also, the crystal habit of the silver halide grains may be cubic, octahedral, tetradecahedral, tabular of a high aspect ratio, etc.

Practical examples of the silver halide emulsion for use in this invention are described in U.S. Pat. No. 4,500,626, Column 50, U.S. Pat. No. 4,628,021, *Research Disclosure,* No. 17029 (1978), JP-A-62-253159, etc.

The silver halide emulsion may be used as a primitive emulsion but is usually chemically sensitized. In this case, a sulfur sensitization method, a reduction sensitization method, a noble metal sensitization method, etc., which are known for ordinary photographic light-sensitive materials can be used singly or as a combination thereof. These chemical sensitizations can be carried out in the presence of a nitrogen-containing heterocyclic compound as disclosed in JP-A-62-253159.

The coating amount of the light-sensitive silver halide for use in this invention is in the range of from 1 mg/m$^2$ to 10 g/m$^2$ calculated as silver.

In this invention, an organic metal salt can be used together with the light-sensitive silver halide as an oxidizing agent. Among these organic metal salts, an organic silver salt is particularly preferably used.

As an organic compound capable of use for agent, there are benzotriazoles described in U.S. Pat. No. 4,500,626, Columns 52 to 53, fatty acids, etc. Also, the silver salts of carboxylic acids having an alkyl group, such as phenyl propiolic acid silver described in JP-A-60-113235 and acetylene silver described in JP-A-61-249044 are useful a the organic silver salt oxidizing agent. Organic silver salts may be used singly or as a mixture thereof.

The organic silver salt can be used in an amount of from 0.01 to 10 moles, and preferably from 0.01 to 1 mole per mole of the light-sensitive silver halide.

The sum of the proper coating amounts of the light-sensitive silver halide and the organic silver salt is from 50 mg/m$^2$ to 10 g/m$^2$ calculated as silver.

In this invention, various antifoggants or photographic stabilizers can be used. Examples of them are azoles and azaindenes described in RD, No. 17643, pages 24 to 25 (1978), nitrogen-containing carboxylic acids and phosphoric acids described in JP-A-59-168442, mercapto compounds and the metal salts thereof described in JP-A-59-111636, and acetylene compounds described in JP-A-62-87957.

The silver halide for use in this invention may be spectrally sensitized by methine dyes and the like. The dyes for the spectral sensitization include cyanine dyes, merocyanine dyes, complex cyanine dyes, complex merocyanine dyes, holopolar cyanine dyes, hemicyanine dyes, styryl dyes, and hemioxonol dyes.

Practical examples of the sensitizing dyes are described in U.S. Pat. No, 4,617,257, JP-A-59-180550 and JP-A-60-140335, and RD, No. 17029, pages 12 to 13 (1978).

These sensitizing dyes may be used singly or as a combination thereof and a combination of sensitizing dyes is frequently used for the purpose of supersensitization.

The silver halide emulsion may contain a dye which has no spectral sensitizing action by itself and shows a supersensitization in the presence of a sensitizing dye or a compound which does not substantially absorb visible light and shows a supersensitization in the presence of a sensitizing dye as described in U.S. Pat. No. 3,615,641 and JP-A-63-23145.

The sensitizing dye(s) may be added to the silver halide emulsion at, before, or after the chemical ripening thereof, or before or after the nucleus formation of the silver halide grains as disclosed in U.S. Pat. Nos. 4,183,756 and 4,225,666. The addition amount of the sensitizing dye is from about $1\times10^{-8}$ to $1\times10^{-2}$ mole per mole of the silver halide.

As the binder for layers constituting the light-sensitive material and dye-fixing material, a hydrophilic binder is preferably used and examples of the binder are described in JP A-62-253159, pages 26 to 28.

Practically, a transparent or translucent hydrophilic binder is preferred and examples thereof are natural compounds such as proteins (e.g., gelatin and gelatin derivatives), cellulose derivatives, and polysaccharides (e.g., starch, gum arabic, dextran, and pluran) and synthetic high molecular compounds such as polyvinyl alcohol, polyvinylpyrrolidone, acrylamide polymers, etc. Also high water-absorptive polymers described in JP-A-62-245260, that is a homopolymer of a vinyl monomer having —COOM or —$SO_3M$ (wherein M is a hydrogen atom or an alkali metal) and a copolymer of the aforesaid vinyl monomers or of the aforesaid vinyl monomer and other vinyl monomer (e.g., sodium methacrylate, ammonium methacrylate, and Sumika Gel L-5H, trade name, made by Sumitomo Chemical Company, Limited) can be used. These binders may be used as a combination thereof.

In the case of employing a system of carrying out heat-development by supplying slight amount of a water, the absorption of water can be quickened by using the aforesaid high water-absorptive polymer. Also, when the high water-absorptive polymer is used for the dye-fixing layer and a protective layer, the retransfer of dye(s) from a dye-fixing material to other material after transferring is prevented.

In this invention, the coating amount of the binder is preferably not more than 20 g, more preferably not more than 10 g, and particularly preferably not more than 7 g per square meter of the light sensitive material.

The layers (including a back layer) constituting the light-sensitive material or the dye-fixing material can contain various polymer latexes for improving the film properties such as the dimensional stability, the curling prevention, the sticking prevention, the cracking prevention of layers, the prevention of the occurences of pressure sensitization or desensitization. Practical examples of the polymer latexes are described in JP-A-62-245258, JP-A-62-136648, and JP-A-62-110066. In particular, when a polymer latex having a low glass transition point not higher than 40° C.) is used for a mordant layer, the occurence of cracking of the mordant layer can be prevented and also when a polymer latex having a high glass transition point is used for a back layer, the curling preventing effect can be obtained.

In this invention, a compound capable of activating the development and also stabilizing the images formed can be used for the light-sensitive material. Practical examples of the preferred compound are described in U.S. Pat. No. 4,500,626, columns 51 to 52.

In the system of forming color images by the diffusion transfer of dye(s), dye-fixing material is used together with the light-sensitive material. The dye-fixing material and the light-sensitive material may be a form of being formed on separate supports or a form of being formed on the same support.

The relation of the light-sensitive material and the dye-fixing material, the relation of the above materials and supports, and the relation with a white reflecting layer, which can be used in this invention, are described in, e.g. U.S. Pat. No. 4,500,626, column 57.

The dye-fixing material which is preferably used in this invention has at least one layer containing a mordant and a binder. Mordants which are known in the field of photography can be used in this invention. Practical examples of the mordant are described in U.S. Pat. No. 4,500,626, column 58 to 59 and JP-A-61-88256, pages 32 to 41 and particularly preferred examples thereof are described in JP-A-62-244043 and JP-A-62-244036. Also, the dye-acceptive high molecular compounds described in U.S. Pat. No. 4,463,079 can be also used in this invention.

The dye-fixing material can have, if necessary, auxiliary layers such as a protective layer, a releasing layer, a curling prevention layer, etc. In particular, the formation of a protective layer is useful.

For the layers constituting the light-sensitive material and the dye fixing material, a high-boiling organic solvent can be used as a plasticizer, slipping agent, or an agent for improving the releasing property of the dye-fixing material from the light-sensitive material. Practical examples of the solvent are described in JP-A-62-253159, page 25 and JP-A-62-245253.

Furthermore, for the aforesaid purpose, various silicone oils (dimethylsilicone oil and other modified silicone oils by introducing various organic groups to dimethyl siloxane) can be used. Examples thereof are various modified silicone oils described in *Modified Silicone Oil,* Technical Material P6-18B, published by Shin-Etsu Silicone K. K. and, in particular, carboxymodified silicone (trade name, X-22-3710), etc.

Also, the silicone oils described in JP-A-62-215953 and JP-A-63-46449 are effectively used in this invention.

For the light-sensitive material and the dye-fixing material, a discoloration inhibitor may be used. As the discoloration inhibitor, there are, for example, antioxidants, ultraviolet absorbents, and a certain kind of metal complexes.

Examples of the antioxidant are chroman series compounds, coumaran series compounds, phenol series compounds (e.g., hindered phenols), hydroquinone derivatives, hindered amine derivatives, and spiroindane series compounds. Also, the compounds described in JP-A-61-159644 are effective.

Examples of the ultraviolet absorbent are benzotriazole series compounds as described in U.S. Pat. No. 3,533,794, etc., 4-thiazolidone series compounds as described in U.S. Pat. No. 3,352,681, etc., benzophenone series compounds as described in JP-A-46-2784, etc., and the compounds described in JP-A-54-48535, JP-A-62-136641, JP-A-61-88256, etc. Also, the ultraviolet absorptive polymers described in JP-A-62-260152 are effective.

As the metal complexes which can be used as the discoloration inhibitor, there are the compounds described in U.S. Pat. Nos. 4,241,155, 4,245,018 (columns to 36), 4,254,195 (columns 3 to 8), JP-A-62-174741, JP-A-61-88256 (pages 27 to 29), JP-A-63-199248, Japanese Patent Application Nos. 62-234103, and 62-230595 (corresponding to JP A-1-75568 and JP-A-1-74272, respectively).

Examples of the useful discoloration inhibitors are described in JP-A-62-215272, pages 125 to 137.

For inhibiting dyes transferred to a dye-fixing material from being discolored, the discoloration inhibitor may be previously incorporated in the dye-fixing material or may be supplied to the dye-fixing material from outside such as from the light-sensitive material.

The aforesaid antioxidant, ultraviolet absorbent and metal complex may be used as a combination of them.

Also, for the light-sensitive material and the dye-fixing material, a brightening agent may be used. In this respect, it is preferred that the brightening agent exists in the dye-fixing material or is supplied from outside such as from the light-sensitive material, etc.

Practical examples of the brightening agent are described in K. Veenkataraman, *the Chemistry of Synthetic Dyes,* Vol. V, Chapter 8 and JP-A-61-143752. More practically, there are stilbene series compounds, coumarin series compounds, biphenyl series compounds, benzoxazolyl series compounds, naphthalimide series compounds, pyrazolidone series compounds, carbostyryl series compounds, etc.

A combination of the brightening agent and the discoloration inhibitor can be also used in this invention.

As hardening agents which are used for layers constituting the light-sensitive material and the dye-fixing material, there are hardening agents described in U S. Pat. No. 4,678,739 (column 41), JP-A-59-116655, JP-A-62-245261 and JP-A-61-18942. Practical examples thereof are aldehyde series hardening agents (formaldehyde, etc.), aziridine series hardening agents, epoxy series hardening agents

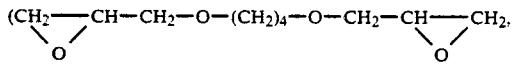

etc.), vinylsulfone series hardening agents [N,N'-ethylene-bis(vinylsulfonylacetamido)ethane, etc.], N-methylol series hardening agents (dimethylolurea, etc.), and high molecular hardening agents (the compounds described in JP-A-62-234157, etc.).

The layers constituting the light-sensitive material or the dye fixing material may contain various surface active agents as coating aids o for the purposes of improving releasability and slipping property, imparting antistatic properties and accelerating development. Examples of surface active agents are described in JP-A-62-173463 and JP-A-62-183457.

The layers constituting the light-sensitive material and the dye-fixing material may contain an organic fluoro compound for the purposes of improving slipping property, static prevention, improving releasability, etc.

Typical examples of the organic fluoro compound are the fluorine series surface active agents described in JP-B-57-9053, columns 8-17, JP-A-61-20944 and JP-A-62-135826 and hydrophobic fluorine compounds such as oily fluorine compounds (e.g., fluorine oil) and solid fluorine compound resins (e.g., tetrafluoroethylene resin).

A matting agent can be used in the light-sensitive material and dye-fixing material.

As the matting agent, there are silicon dioxide, the compounds described in JP-A-61-88256 (page 29), such as polyolefin and polymethacrylate and the compounds described in Japanese Patent Application Nos. 62-110064 and 62-110065 (corresponding to JP-A-63-274944 and JP-A-3-274952, respectively), such as benzoguanamine resin beads, polycarbonate resin beads, AS resin beads, etc.

Furthermore, the layers constituting the light-sensitive material and the dye-fixing material may further contain a thermal solvent, a defoaming agent, an antibacterial antifungal agent, colloidal silica, etc. Practical examples of these additives are described in JP-A-61-88256, pages 26 to 32.

In the light-sensitive material and/or the dye-fixing material there can be used image formation accelerators. An image formation accelerator has functions of accelerating the oxidation reduction reaction of the silver salt oxidizing agent and the reducing agent, accelerating the reaction of forming dyes from the dye-providing compounds, decomposing dye, or releasing diffusible dyes, and accelerating the transfer of dyes from the light-sensitive layers to the dye-fixing layer. From the physicochemical functions, the image formation accelerators are classified into bases or base precursors, nucleophilic compounds, high-boiling organic solvents (oils), thermal solvents, surface active agents, compounds having a co-action with silver or silver ions, etc. These substances generally have composite functions and usually have two or more of the aforesaid acceleration effects. Details thereof are described in U.S. Pat. No. 4,678,739, columns 38 to 40.

As the base precursor, there are mentioned a salt of a base and an organic acid causing decarboxylation by heat and compounds capable of releasing amines by an intramolecular nucleophilic substitution reaction, a Lossen rearrangement, or a Beckmann rearrangement. Practical examples thereof are described in U.S. Pat. No. 4,511,493 and JP-A-62-65038.

In the system of simultaneously carrying out the heat development and the transfer of dyes in the existence of a small amount of water, it is preferred for increasing the shelf life of the light-sensitive material to incorporate the base and/or the base pecursor in the dye-fixing material.

In addition to the aforesaid base precursors, the combination of sparingly water soluble metal compounds and compounds capable of causing a complex-forming reaction with the metal ions forming the sparingly water-soluble compounds described in EP-A-210660 and U.S. Pat. No. 4,740,445 and the compound of forming a base by electrolysis described in JP-A-61-232451 can be used as the base precursors. In particular, the former method is effective. In the aforesaid case, it is advantageous that the sparingly water-soluble metal compound and the complex-forming compound are separately incorporated in the light-sensitive material and the dye-fixing material, respectively.

For the light-sensitive material and/or the dye-fixing material of this invention, various development stopping agents can be used for always obtaining constantly stable images to the deviations of the processing temperature and the processing time at development.

The development stopping agent is a compound capable of quickly neutralizing a base or quickly reacting with the base after the appropriate development to reduce the concentration of the base in the layer(s) and to stop the development, or a compound capable of causing a co-action with silver and a silver salt to restrain the development.

Practically, the development stopping agent is an acid precursor releasing an acid by heating, an electrophilic compound causing a substitution reaction with a co-existing base by heating, a nitrogen-containing heterocyclic compound, a mercapto compound, and precursors thereof. Details of these compounds are described in JP-A-62-253159, pages 31 to 32.

As the support for the light-sensitive material and the dye-fixing material in this invention, a material enduring the processing temperature is preferred. The material is generally a paper and a synthetic polymer (film).

Practical examples of the support are films of polyethylene terephthalate, polycarbonate, polyvinyl chloride, polystyrene, polypropylene, polyimide, celluloses (e.g., triacetyl cellulose), etc., the aforesaid films containing a pigment such as titanium oxide, etc., synthetic papers formed by polypropylene, etc., papers made of a mixture of a synthetic resin pulp such as polyethylene and a natural pulp, Yankee papers, baryta-coated papers, resin-coated papers (cast coating papers), metal sheets, cloths, glass sheets, etc.

The paper support, etc., can be used as it is or as a coated paper one surface or both the surfaces of which are coated with a synthetic polymer such as polyethylene, etc.

Furthermore, the supports described in JP-A-62-253159, pages 29 to 31 can be used.

The surface of the support may be coated with a mixture of a hydrophilic binder, a semiconductive metal oxide such as an alumina sol and tin oxide, and an antistatic agent such as carbon black, etc.

As a method of imagewise exposing the light-sensitive material, there are mentioned a method of directly photographing a scene, a person, etc., using a camera, etc., a method of exposing through a reversal film or a negative film using a printer or an enlarger, etc., a method of scanning-exposing an original through a slit, etc., using an exposure device of a copying machine, a method of exposing to light emitted from a light emitting diode or laser through electric signals according to an image information, and a method of displaying an image information on an image display device such as CRT (cathod ray tube), a liquid crystal display, an electroluminescence display, a plasma display, etc., and exposing to the displayed images directly or through an optical system.

As a light source for recording images to the light-sensitive material, there are natural light, a tungsten lamp, a light emitting diode, a laser light source, and a CRT light source, etc., as described in U.S. Pat. No. 4,500,626, column 56.

Also, the image-exposure can be applied by using a wavelength conversion element composed of a combination of a non-linear optical material and a coherent light source such as laser light, etc.

The non-linear optical material is a material capable of giving a non linearity between the polarization and the electric field appearing on applying a strong photoelectric field such as laser light and examples of the material are inorganic compounds such as lithium niobate, potassium dihydrogenphosphate (KDP), lithium iodate, $BaB_2O_4$, etc.; urea derivatives; nitroaniline derivatives; nitropyridine-N-oxide derivatives such as 3-methyl-4-nitropyridine-N-oxide (POM), and the compounds described in JP-A-61-53462 and JP-A-62-210432.

As the form of the wavelength conversion element, a single crystal light waveguide type form, a fiber type form, etc., are known and they are all useful.

Also, as the aforesaid image information, an image signal obtained from a video camera, electron still camera, etc., a television signal such as Nippon Television Signal Code (NTSC), an image signal obtained by dividing a original into many dots by scanner, etc. and an image signal made by using a computer such as CG and CAD.

The light-sensitive material and/or the dye-fixing material may be in the form of having a conductive exothermic layer as a heating means for the heat development or the diffusion transfer of dyes. In this case, the transparent or opaque exothermic elements described in JP-A-61-145544 can be utilized. The conductive layer also functions as an antistatic layer.

The heating temperature for the heat development step is from about 50° C. to about 250° C., and particularly usefully from about 80° C. to about 180° C.

The diffusion transfer step of dyes may be carried out simultaneously with the heat development or after finishing the heat development step. In the latter case, the heating temperature for transferring dyes in the transfer step may be in the range of from room temperature to a temperature in the heat development step but heating temperature is preferably in the range of from about 50° C. to a temperature of about 10° C. lower than the temperature in the heat development step.

The transfer of dyes may occur by heat only but for accelerating the transfer of dyes, a solvent may be used.

Also, as described in detail in JP-A-59-218443 and JP-A-61-238056, a method of heating in the existence of a small amount of a solvent (in particular, water) to carry out the development and the transfer of dyes simultaneously or in succession is useful in this invention. In this method, the heating temperature is preferably from 50° C. to the boiling point of the solvent. For example, when the solvent is water, the heating temperature is preferably from 50° C. to 100° C.

Examples of the solvent which is used for accelerating the development and/or transferring diffusible dyes to the dye-fixing layer are water and a basic aqueous solution of an inorganic alkali metal salt or an organic base (as the base, those described above on the image formation accelerators can be used).

Also, a low-boiling solvent or a mixture of a low-boiling solvent and water or the basic aqueous solution can be used. Furthermore, the solvent may contain a surface active agent, an antifoggant, a sparingly water-soluble metal salt, a complex-forming compound, etc.

The solvent can be used in a method of being applied to the dye-fixing material and/or the light-sensitive material. The amount of the solvent may be small such as an amount of not more than the weight of the solvent corresponding to the maximum swelled volume of the total coated layers (in particular, not more than the amount obtained by subtracting the weight of the total coated layers from the weight of the solvent corresponding to the maximum swelled volume of the total coated layers).

As a method of applying a solvent to the light-sensitive layer or the dye-fixing layer, there is, for example, the method described in JP-A-61-147244, page 26. Also, the solvent may be previously incorporated in the light-sensitive material and/or the dye-fixing material in the form of being encapsulated in microcapsules, etc.

Also, for accelerating the dye transfer, a system of incorporating a hydrophilic thermal solvent which is solid at room temperature but is melted at high temperature in the light-sensitive material or the dye-fixing material may be employed. The hydrophilic thermal solvent ma exist in either the light-sensitive material or the dye-fixing material or in both the light-sensitive material and the dye-fixing material. Also, the layer containing the hydrophilic thermal solvent may be an emulsion layer or emulsion layers, an interlayer, a protective layer, or a dye-fixing layer but it is preferred that the solvent is incorporated in the dye-fixing layer and/or a layer adjacent to the dye-fixing layer.

Examples of the hydrophilic thermal solvent are ureas, pyridines, amides, sulfonamides, imides, alcohols, oximes, and heterocyclics.

Also, for accelerating the dye transfer, a high-boiling organic solvent may be incorporated in the light-sensitive material and/or the dye-fixing material.

As a heating method in the heat development step and/or the dye transfer step, there are a method of contacting with a heated block or plate, a method of contacting with a hot plate, a hot pressor, a heat roller, a halogen lamp heater, or an infrared or far infrared lamp heater, and a method of passing through a high-temperature atmosphere.

Also, in case of superposing the dye-fixing material onto the light-sensitive material and applying a pressure to the assembly for the purpose of closely superposing them, the pressing method and the pressing condition as described in JP-A-61-147244, page 27 can be suitably employed in this invention.

For the treatment of the photographic elements of this invention, various heat developing apparatus can be used. Examples of the apparatus are described in JP-A-59-75247, JP-A-59-177547, JP-A-59-181353, JP-A-60-18951, and JP-A-U-62-25944 (the term "JP-A-U" as used herein means an "unexamined published Japanese utility model application").

The following examples are intended to illustrate this invention but not to limit it in any way.

EXAMPLE 1

Emulsion (I) for Layer 5 (5th layer) was prepared as follows.

To an aqueous gelatin solution (prepared by adding 20 g of gelatin, 3 g of potassium bromide, and 0.3 g of $HO(CH_2)_2S(CH_2)_2S(CH_2)_2OH$ to 800 ml of water and keeping the solution at 55° C.) were simultaneously added the following solution (1) and solution (2) shown below with stirring vigorously over a period of 30 minutes. Thereafter, solution (3) and solution (4) shown below were simultaneously added to the mixture over a period of 20 minutes. Also, after 5 minutes since the initiation of the addition of solution (3), the dye solution shown below was added to the mixture over a period of 18 minutes.

After washing the resultant mixture with water and desalting, 20 g of lime-processed ossein gelatin was added thereto and after adjusting the pH and pAg thereof to 6.2 and 8.5, respectively, sodium thiosulfate, 4-hydroxy 6-methyl-1,3,3a-7-tetraazaindene, and chloroauric acid were added to the mixture, thereby the emulsion was most suitably chemically sensitized.

Thus, 600 g of a monodisperse tetradecahedral silver iodobromide emulsion having a mean grain size of 0.40 μm was obtained.

Solution (1): Aqueous solution of 30 g of $AgNO_3$ dissolved in 180 ml of water.

Solution (2): Aqueous solution of 20 g of KBr and 1.8 g of KI dissolved in 180 ml of water.

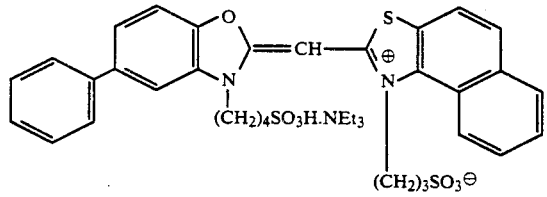

0.12 g

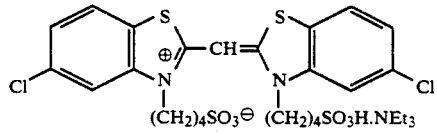

0.12 g

Emulsion (II) for Layer 3 was prepared as follows.

To an aqueous solution (prepared by adding 20 g of gelatin, 0.30 of potassium bromide, 6 g of sodium chloride, and 0.015 g of Chemical A shown below to 730 ml of water and keeping the solution at 60.0° C.) were simultaneously added solution (I') and solution (II') shown below with stirring vigorously at equivalent flow rates over a period of 60 minutes. After the completion of addition of solution (I'), methanol solution (III') of the following Sensitizing Dye C was added to the mixture. Thus, a dye-adsorbed monodisperse cubic emulsion having a mean grain size of 0.45 μm was prepared.

After washing the emulsion with water and desalting, 20 g of gelatin was added thereto and after adjusting the pH and pAg thereof to 6.4 and 7.8, respectively, the emulsion was chemically sensitized at 60.0° C. In this case, 1.6 mg of triethylthiourea and 100 mg of 4-hydroxy-6-methyl-1,3,3a-7-tetraazaindene were used and the ripening time was 55 minutes. Also, the amount of the emulsion obtained was 635 g.

Chemical A:

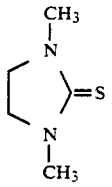

Sensitizing Dye C:

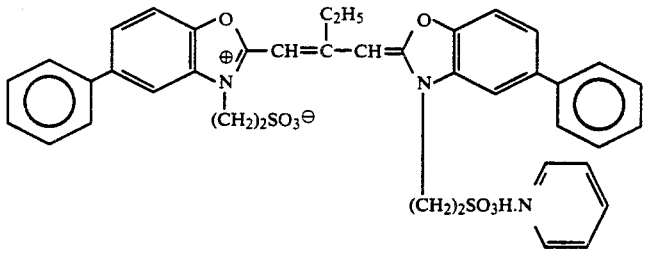

Solution (3): Aqueous solution of 70 g of $AgNO_3$ dissolved in 350 ml of water.

Solution (4): Aqueous solution of 49 g of KBr dissolved in 350 ml of water.

Dye solution: A solution formed by dissolving the following dyes in 160 ml of methanol.

Solution (I'): Aqueous solution of 100.0 g of $AgNO_3$ dissolved in 400 ml of water.

Solution (II'): Aqueous solution of 56.0 g of KBr and 7.2 9 of NaCl dissolved in 400 ml of water.

Solution (III'): Aqueous solution of 0.23 g Sensitizing Dye C dissolved in 77 ml of methanol.

Emulsion (III) for Layer 1 was prepared as follows. To an aqueous gelatin solution (prepared by adding 20 g of gelatin, 1 g of potassium bromide, and 0.5 g of $HO(CH_2)_2S(CH_2)_2OH$ to 800 ml of water and keeping the solution at 50° C.) were simultaneously added solution (I''), solution (II'') and solution (III'') shown below with stirring vigorously at an equivalent flow rate over a period of 30 minutes. Thus, a dye-adsorbed monodisperse silver bromide emulsion having a mean grain size of 0.42 μm was prepared.

After washing the emulsion with water and desalting, 20 g of lime-processed ossein gelatin was added to the emulsion and after adjusting the pH and pAg thereof at 6.4 and 8.2, respectively and keeping the emulsion at 60° C., 9 mg of sodium thiosulfate, 6 ml of an aqueous solution of 0.01% chloroauric acid, and 190 mg of 4-hydroxy-6-methyl-1,3,3a,7-tetraazaindene were added thereto followed by carrying out the chemical sensitization for 45 minutes. The amount of the emulsion obtained was 635 g.

Solution (I''): Aqueous solution of 100 g of $AgNO_3$ dissolved in 450 ml of water.

Solution (II''): Aqueous solution of 70 g of KBr dissolved in 400 ml of water.

Solution (III''): Aqueous solution of 40 mg of Dye (a) and 80 mg of Dye (b) dissolved in 60 ml of methanol.

Dye (a)

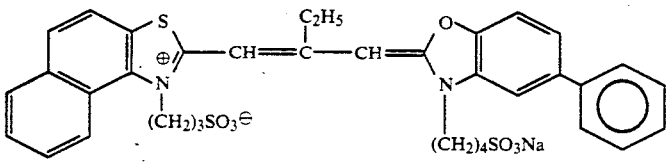

Dye (b)

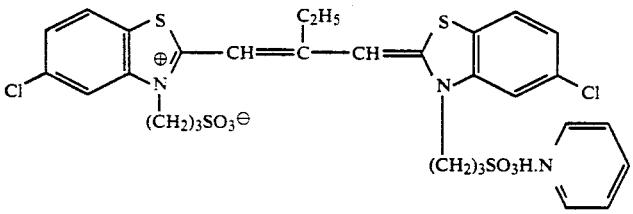

A dispersion of zinc hydroxide was prepared as follows.

To 100 ml of an aqueous 4% gelatin solution were added 12.5 g of zinc hydroxide having a mean grain size of 0.2 μm and 1 g of carboxymethyl cellulose and 0.1 g of sodium polyacrylate as dispersing agents and the zinc hydroxide was pulverized in a mill for 30 minutes using glass beads having a mean grain size of 0.75 mm. Then, by separating the glass beads, a dispersion of zinc hydroxide was obtained.

A dispersion of active carbon was prepared as follows.

To 100 ml of an aqueous 5% gelatin solution were added 2.5 g of active carbon powder (reagent, superior class) made by Wako Pure Chemical Industries, Ltd. and 1 g of Demor N (trade name, made by Kao Corporation) and 0.25 g of polyethylene glycol nonylphenyl ether as dispersing agents, and the active carbon was pulverized in a mill for 120 minutes using glass beads having a mean grain size of 0.75 mm. By separating the glass beads, a dispersion of active carbon having a mean grain size of 0.5 μm was obtained.

Then, a dispersion of an electron transfer agent was prepared as follows.

To 100 ml of an aqueous 5% gelatin solution were added 10 g of electron transfer agent (X-2) shown below and 0.5 g of polyethylene glycol nonylphenyl ether and 0.5 g of anionic surface active agent shown below as dispersing agents and the electron transfer agent was pulverized in a mill for 60 minutes using glass beads having a mean grain size of 0.75 mm. By separating the glass beads, a dispersion of the electron transfer agent having a mean grain size of 0.3 μm was obtained.

Electron Transfer Agent (X-2):

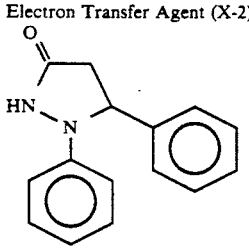

Anionic Surface Active Agent:

$$NaO_3S-\underset{}{\overset{CH_2COOCH_2CH(C_2H_5)C_4H_9}{\overset{|}{CH}}}COOCH_2CH(C_2H_5)C_4H_9$$

Then, gelatin dispersions of the following dye-providing compounds, respectively, were prepared as follows.

Each of the yellow, magenta, and cyan dye-providing compounds shown below was added to 50 ml of ethyl acetate together with the components shown below and the mixture was heated to about 60° C. to form each homogeneous solution. After adding 100 g of an aqueous 10% lime-processed gelatin solution, 0.6 g of sodium dodecylbenzenesulfonate, and 50 ml of water to each solution thus prepared with stirring, the resultant mixture was dispersed by a homogenizer at 10,000 r.p.m. for 10 minutes.

The dispersion is called a gelatin dispersion of a dye-providing compound.

Gelatin Dispersion of Yellow Dye-Providing Compound

Composition of 13 g of Yellow Dye-Providing Compound (1), 10.2 g of electron donor (ED-9), 6.5 g of high-boiling solvent (1) shown below, and 0.8 g of electron transfer agent precursor (2) shown below.

Gelatin Dispersion of Magenta Dye-Providing Compound

Composition of 15.5 g of Magenta Dye-Providing Compound (2), 8.6 g of the electron donor (ED-9), 7.8 g of the high-boiling solvent (1) shown below, and 0.13 g of electron transfer agent precursor (2) shown below.

Gelatin Dispersion of Cyan Dye-Providing Compound

Composition of 16.6 g of Cyan Dye-Providing Compound (3), 8.1 g of the electron donor (ED-9), 8.3 g of the high-boiling solvent (1) shown below, and 0.13 g of the electron transfer agent precursor (2) shown below.

High-Boiling-Solvent (1):

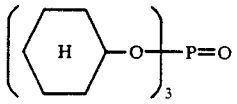

Electron Transfer Agent Precursor (2):

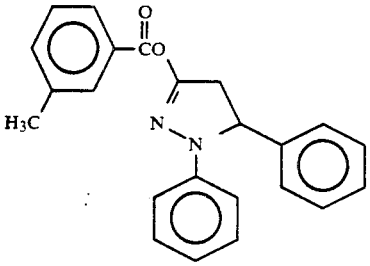

Then, a gelatin dispersion of electron donor (3) for an interlayer was prepared as follows.

To 30 ml of ethyl acetate were added 23.6 g of the electron donor (3) shown below and 8.5 g of the aforesaid high-boiling solvent (1) to form a homogeneous solution.

The solution was mixed with 100 g of an aqueous solution of 10% lime-processed gelatin, 0.25 g of sidium hydrogensulfite, 0.3 g of sodium dodecylbenzenesulfonate, and 30 ml of water with stirring and the mixture was dispersed by a homogenizer at 10,000 r.p.m. for 10 minutes.

The dispersion is called as a gelatin dispersion of electron donor (3)

Electron Donor (3)

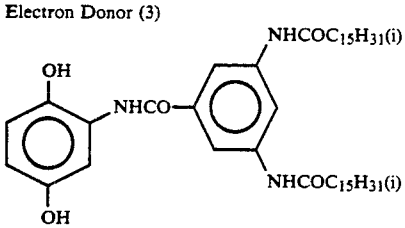

A multilayer heat-developable color photographic light-sensitive material 101 having the following layers was prepared using the aforesaid emulsion and dispersion

| | |
|---|---|
| Layer 6 Protective Layer | |
| Gelatin | 900 mg/m$^2$ |
| Silica (size 4 μm) | 40 mg/m$^2$ |
| Polyvinyl Alcohol (*9) | 120 mg/m$^2$ |
| Zinc Hydroxide | 600 mg/m$^2$ |
| Surface Active Agent (4) (*1) | 130 mg/m$^2$ |
| Surface Active Agent (5) (*2) | 26 mg/m$^2$ |
| Water-Soluble Polymer (*3) | 8 mg/m$^2$ |
| Layer 5 Blue-Sensitive Emulsion Layer | |
| Light-Sensitive Silver Halide | 380 mg/m$^2$ |
| Emulsion (I) | as silver |
| Yellow Dye-Providing Compound (1) | 400 mg/m$^2$ |
| Gelatin | 600 mg/m$^2$ |
| Electron Donor (ED-9) | 308 mg/m$^2$ |
| High-Boiling Solvent (1) | 200 mg/m$^2$ |
| Electron Transfer Agent Precursor (2) | 30 mg/m$^2$ |
| Zinc Hydroxide | 330 mg/m$^2$ |
| Antifoggant (6) (*4) | 0.6 mg/m$^2$ |
| Surface Active Agent (7) (*5) | 18 mg/m$^2$ |
| Water-Soluble Polymer (*3) | 13 mg/m$^2$ |
| Layer 4 Interlayer | |
| Gelatin | 700 mg/m$^2$ |
| Lactose | 500 mg/m$^2$ |
| Electron Donor (3) | 130 mg/m$^2$ |
| High-Boiling Solvent (1) | 48 mg/m$^2$ |
| Surface Active Agent (5) (*2) | 15 mg/m$^2$ |
| Surface Active Agent (8) (*6) | 61 mg/m$^2$ |
| Surface Active Agent (7) (*5) | 2 mg/m$^2$ |
| Electron Transfer Agent (X-2) | 81 mg/m$^2$ |
| Water-Soluble Polymer (*3) | 19 mg/m$^2$ |
| Hardening Agent (9) (*7) | 37 mg/m$^2$ |
| Layer 3 Green-Sensitive Emulsion Layer | |
| Light-Sensitive Silver Halide | 220 mg/m$^2$ |
| Emulsion (II) | as silver |
| Magenta Dye-Providing Compound (2) | 365 mg/m$^2$ |
| Gelatin | 310 mg/m$^2$ |
| Electron Donor (ED-9) | 158 mg/m$^2$ |
| High-Boiling Solvent (1) | 183 mg/m$^2$ |
| Electron Transfer Agent Precursor (2) | 30 mg/m$^2$ |
| Surface Active Agent (7) (*5) | 13 mg/m$^2$ |
| Water-Soluble Polymer (*3) | 11 mg/m$^2$ |
| Antifoggant (10) (*8) | 0.8 mg/m$^2$ |
| Layer 2 Interlayer | |
| Gelatin | 790 mg/m$^2$ |
| Zinc Hydroxide | 300 mg/m$^2$ |
| Electron Donor (3) | 130 mg/m$^2$ |
| High-Boiling Solvent (1) | 73 mg/m$^2$ |
| Surface Active Agent (7) (*5) | 2 mg/m$^2$ |
| Surface Active Agent (8) (*6) | 100 mg/m$^2$ |
| Surface Active Agent (5) (*2) | 11 mg/m$^2$ |
| Water-Soluble Polymer (*3) | 12 mg/m$^2$ |
| Active Carbon | 25 mg/m$^2$ |
| Layer 1 Red-Sensitive Emulsion Layer | |
| Light-Sensitive Silver Halide | 230 mg/m$^2$ |
| Emulsion (III) | as silver |
| Cyan Dye-Providing Compound (3) | 343 mg/m$^2$ |
| Gelatin | 330 mg/m$^2$ |
| Electron Donor (ED-9) | 163 mg/m$^2$ |
| High-Boiling Solvent (1) | 172 mg/m$^2$ |
| Electron Transfer Agent Precursor (2) | 34 mg/m$^2$ |
| Surface Active Agent (7) (*5) | 10 mg/m$^2$ |
| Water-Soluble Polymer (*3) | 5 mg/m$^2$ |
| Antifoggant (10) (*8) | 0.7 mg/m$^2$ |
| Support | |
| Polyethylene terephthalate film of 96 μm in thickness coated with carbon black as the back layer. | |

The compounds used are as follows.

*1): Surface Active Agent (4)

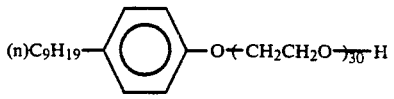

-continued

*2): Surface Active Agent (5)

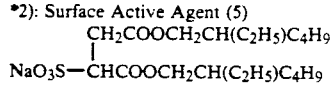

*3): Water-Soluble Polymer

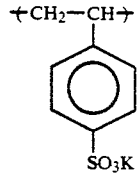

*4): Antifoggant (6)

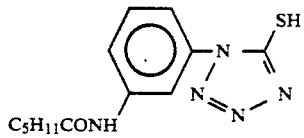

*5): Surface Active Agent (7)

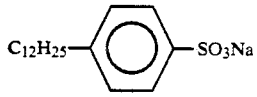

*6): Surface Active Agent (8)

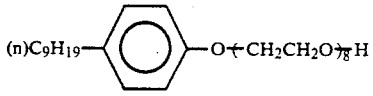

*7): Hardening Agent (9)
1,2-Bis(vinylsulfonylacetamido)ethane

*8): Antifoggant (10)

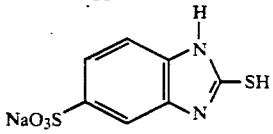

*9): Polyvinyl alcohol
(molecular weight: 2,000)

Then, a dye-fixing material R-1 having the following layers was prepared.

| | |
|---|---|
| Layer 3 | |
| Gelatin | 0.05 g/m$^2$ |
| Silicon Oil (1) | 0.04 g/m$^2$ |
| Surface Active Agent (1) | 0.001 g/m$^2$ |
| Surface Active Agent (2) | 0.02 g/m$^2$ |
| Surface Active Agent (3) | 0.10 g/m$^2$ |
| Matting Agent (1) | 0.02 g/m$^2$ |
| Guanidine Picolinate | 0.45 g/m$^2$ |
| Water-Soluble Polymer (1) | 0.24 g/m$^2$ |
| Layer 2 | |
| Mordant (1) | 2.35 g/m$^2$ |
| Water-Soluble Polymer (1) | 0.20 g/m$^2$ |
| Gelatin | 1.40 g/m$^2$ |
| Water-Soluble Polymer (2) | 0.60 g/m$^2$ |
| High-Boiling Solvent (1) | 1.40 g/m$^2$ |
| Guanidine Picolinate | 2.25 g/m$^2$ |
| Brightening Agent (1) | 0.05 g/m$^2$ |
| Surface Active Agent (5) | 0.15 g/m$^2$ |
| Layer 1 | |
| Gelatin | 0.45 g/m$^2$ |
| Surface Active Agent (3) | 0.01 g/m$^2$ |
| Water-Soluble Polymer (1) | 0.04 g/m$^2$ |
| Hardening Agent (1) | 0.30 g/m$^2$ |
| Support | |

-continued

| | |
|---|---|
| Back Layer 1 | |
| Gelatin | 3.25 g/m$^2$ |
| Hardening Agent (1) | 0.25 g/m$^2$ |
| Back Layer 2 | |
| Gelatin | 0.44 g/m$^2$ |
| Silicone Oil (1) | 0.08 g/m$^2$ |
| Surface Active Agent (4) | 0.04 g/m$^2$ |
| Surface Active Agent (5) | 0.01 g/m$^2$ |
| Matting Agent (2) | 0.03 g/m$^2$ |

Structure of Support

| Layer | Composition | Layer Thickness (μm) |
|---|---|---|
| Surface Undercoat Layer | Gelatin | 0.1 |
| Surface PE Layer (Glossy) | Low-density Polyethylene: 89.2 parts (Density: 0.923) Surface-treated Titanium Oxide: 10.0 parts Ultramarine 0.8 part | 45.0 |
| Pulp Layer | Best Quality Paper (LBKP/NBKP = 1:1, Density: 1.080) | 92.6 |
| Back PE Layer (Mat) | High-density Polyethylene (Density: 0.960) | 36.0 |
| Back Undercoat Layer | Gelatin | 0.05 |
| | Colloidal Silica | 0.05 |
| | Total | 173.8 |

The compounds used for the dye-fixing material are as follows.

Silicone Oil (1)

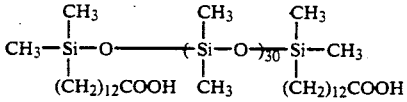

Surface Active Agent (1)

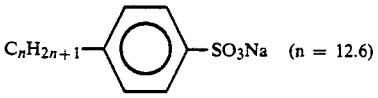

Surface Active Agent (2)

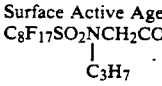

Surface Active Agent (3)

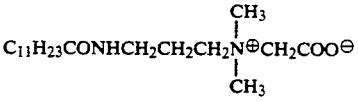

Surface Active Agent (4)

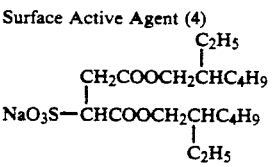

Brightening Agent (1)
2,5-Bis(5-t-butylbenzoxazole (2))thiophene

Surface Active Agent (5)

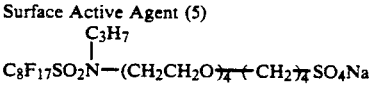

-continued

Water-Soluble Polymer (1)
Sumikagel L5-H (a product of Sumitomo Chemical Co., Ltd.)

Water-Soluble Polymer (2)
Dextran (MW = 70,000)

Mordant (1)

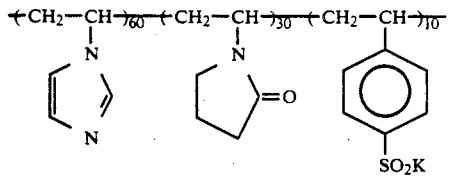

High-Boiling Solvent (1)

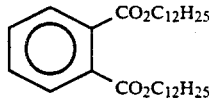

Hardening Agent (1)

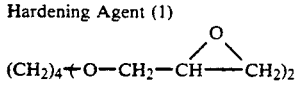

Matting Agent (1)
Silica (average particle size: 4 μm)

Matting Agent (2)
Benzoguanamine resin (average particle size: 15 μm)

Then, by following the same procedure as the case of preparing the light-sensitive material 101 except that the additives shown in Table 1 below were used, light-sensitive materials 102 to 120 were prepared.

These additives were added in the following manners. That is, when added in Layer 1, 3 or 5, it was added in a high-boiling solvent during preparation of gelatin dispersion of each dye-providing compound; when added in Layer 2 or 4, it was added in a high-boiling solvent during preparation of gelatin dispersion of electron donor for an interlayer; and when added in Layer 6, it was added as a gelatin dispersion of it alone.

TABLE 1

| Light-Sensitive Material | Additive | Added Layer and added amount (mg/m²) 1 | 2 | 3 | 4 | 5 | 6 |
|---|---|---|---|---|---|---|---|
| 101 | — | — | — | — | — | — | — |
| 102 | (1) (Comparison) | 0.03 | — | 0.03 | — | 0.03 | — |
| 103 | (1) (Comparison) | 0.06 | — | 0.06 | — | 0.06 | — |
| 104 | (1) (Comparison) | 0.15 | — | 0.15 | — | 0.15 | — |
| 105 | (2) (Comparison) | 0.04 | — | 0.04 | — | 0.04 | — |
| 106 | (2) (Comparison) | — | 0.04 | — | 0.04 | — | 0.04 |
| 107 | (3) (Comparison) | 0.05 | — | 0.05 | — | 0.05 | — |
| 108 | (3) (Comparison) | — | — | — | 0.16 | — | — |

TABLE 1-continued

| Light-Sensitive Material | Additive | Added Layer and added amount (mg/m²) 1 | 2 | 3 | 4 | 5 | 6 |
|---|---|---|---|---|---|---|---|
| 109 | ES-6 (Invention) | 0.03 | — | 0.03 | — | 0.03 | — |
| 110 | ES-6 (Invention) | 0.06 | — | 0.06 | — | 0.06 | — |
| 111 | ES-6 (Invention) | — | — | — | 0.18 | — | — |
| 112 | ES-12 (Invention) | 0.05 | — | 0.05 | — | 0.05 | — |
| 113 | ES-12 (Invention) | — | 0.03 | — | 0.03 | — | 0.03 |
| 114 | ES-12 (Invention) | — | 0.05 | — | 0.05 | — | 0.05 |
| 115 | ES-16 (Invention) | — | 0.05 | — | 0.05 | — | 0.05 |
| 116 | ES-16 (Invention) | — | — | — | 0.15 | — | — |
| 117 | ES-37 (Invention) | 0.04 | — | 0.04 | — | 0.04 | — |
| 118 | ES-37 (Invention) | — | — | 0.12 | — | — | — |
| 119 | ES-59 (Invention) | 0.06 | — | 0.06 | — | 0.06 | — |
| 120 | ES-59 (Invention) | — | — | — | — | — | 0.18 |

Comparison Compound:

(1) $H_3C-C(=O)-O-C_8H_{17}(n)$ (2) $H_5C_2-C(=O)-O-(CH_2)_3-C(=O)-O-C_8H_{17}(n)$ (3) $C_{16}H_{33}O$

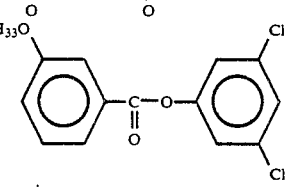

Each of the aforesaid color photographic light-sensitive materials 101 to 120 was exposed to a tungsten lamp for 1/10 second at 5,000 lux through a blue (B), green (G), red (R), or grey color separation filter having continuously changing densities.

While sending the exposed light-sensitive material at a line speed of 20 mm/sec., 15 ml/m² of water was supplied to the emulsion layer surface by a wire bar and thereafter, the light-sensitive material was superposed on the image-recieving material (dye-fixing material) such that the emulsion layer was in contact with the dye-fixing layer.

The assembly was heated for 15 seconds using a heat roller having controlled temperature such that the temperature of the water-absorbed layers became 85° C. Then, the image-receiving material was separated from the light-sensitive material, whereby clear blue, green, red, and grey images were formed on the image-receiving material without unevenness corresponding to the B, G, R, and grey separation filter.

The maximum density (Dmax) and the minimum density (Dmin) of each of the cyan, magenta, and yellow colors in the grey portion were measured and the results obtained are shown in Table 2 below.

TABLE 2

| Light-Sensitive Material | Additive | Dmax Cyan | Magenta | Yellow | Dmin Cyan | Magenta | Yellow | Added Layer No. | Total Amount Added (mg/m²) |
|---|---|---|---|---|---|---|---|---|---|
| 101 | — | 2.10 | 2.22 | 2.03 | 0.16 | 0.18 | 0.18 | — | — |
| 102 | (1) (Comparison) | 2.10 | 2.21 | 2.04 | 0.16 | 0.18 | 0.18 | 1,3,5 | 0.09 |

TABLE 2-continued

| Light-Sensitive Material | Additive | | Dmax Cyan | Dmax Magenta | Dmax Yellow | Dmin Cyan | Dmin Magenta | Dmin Yellow | Added Layer No. | Total Amount Added (mg/m²) |
|---|---|---|---|---|---|---|---|---|---|---|
| 103 | " | " | 2.11 | 2.21 | 2.03 | 0.16 | 0.19 | 0.19 | 1,3,5 | 0.18 |
| 104 | " | " | 2.10 | 2.22 | 2.04 | 0.17 | 0.20 | 0.19 | 1,3,5 | 0.45 |
| 105 | (2) | " | 2.11 | 2.21 | 2.03 | 0.16 | 0.18 | 0.18 | 1,3,5 | 0.12 |
| 106 | " | " | 2.10 | 2.22 | 2.04 | 0.16 | 0.18 | 0.18 | 2,4,6 | 0.12 |
| 107 | (3) | " | 2.11 | 2.22 | 2.03 | 0.16 | 0.18 | 0.18 | 1,3,5 | 0.15 |
| 108 | " | " | 2.10 | 2.22 | 2.04 | 0.16 | 0.19 | 0.18 | 2,4,6 | 0.16 |
| 109 | ES-6 | (Invention) | 2.11 | 2.23 | 2.04 | 0.15 | 0.17 | 0.17 | 1,3,5 | 0.09 |
| 110 | " | " | 2.10 | 2.22 | 2.03 | 0.14 | 0.16 | 0.16 | 2,4,6 | 0.18 |
| 111 | " | " | 2.11 | 2.22 | 2.03 | 0.14 | 0.17 | 0.16 | 4 | 0.18 |
| 112 | ES-12 | " | 2.10 | 2.22 | 2.04 | 0.14 | 0.17 | 0.16 | 1,3,5 | 0.15 |
| 113 | " | " | 2.09 | 2.22 | 2.04 | 0.15 | 0.18 | 0.18 | 2,4,6 | 0.09 |
| 114 | " | " | 2.11 | 2.21 | 2.03 | 0.14 | 0.17 | 0.17 | 2,4,6 | 0.15 |
| 115 | ES-16 | " | 2.09 | 2.23 | 2.03 | 0.14 | 0.17 | 0.16 | 2,4,6 | 0.15 |
| 116 | " | " | 2.10 | 2.22 | 2.04 | 0.14 | 0.17 | 0.17 | 4 | 0.15 |
| 117 | ES-37 | " | 2.11 | 2.22 | 2.03 | 0.14 | 0.16 | 0.17 | 1,3,5 | 0.12 |
| 118 | " | " | 2.10 | 2.23 | 2.04 | 0.14 | 0.17 | 0.17 | 3 | 0.12 |
| 119 | ES-59 | " | 2.10 | 2.22 | 2.03 | 0.14 | 0.16 | 0.16 | 1,3,5 | 0.18 |
| 120 | " | " | 2.10 | 2.22 | 2.04 | 0.14 | 0.17 | 0.17 | 6 | 0.18 |

It is clear from Table 2 that the compound for use in the present invention was superior in improvement of discrimination to that of the comparison compound, when they were used in an equal amount (see Sample 102 vs. Sample 109, Sample 103 vs. Sample 119, and Sample vs. Sample 112). In particular, it is extremely important to make Dmin low in the form of forming an image on a reflective support like the working examples of this invention. Further, the samples of this invention exhibited an excellent tone reproducibility as compared with a control sample and comparative samples.

EXAMPLE 2

A color photographic light-sensitive material having the multilayer structure shown below was prepared using the same silver halide emulsions and the same dye-providing compounds as in the color photographic light-sensitive material 101 in Example 1.

In addition, the additives used were the same as those for the light-sensitive material 101 unless otherwise indicated.

In addition, the organic silver salt emulsion was prepared as follows.

In a mixture of 1,000 ml of an aqueous solution of 0.1% sodium hydroxide and 200 ml of ethanol were dissolved 20 g of gelatin and 5.9 g of 4-acetylamino-phenylpropiolic acid and the solution thus obtained was stirred at 40° C. To the solution was added a solution of 4.5 g of silver nitrate in 200 ml of water over a period of 5 minutes. Then, excessive salt was removed by a sedimentation method. Thereafter, the pH thereof was adjusted to 6.3 to provide 300 g of the organic silver salt emulsion.

In this case, the antifoggant precursor (14) shown below was used in an amount of 0.2 mole times the amount of the dye-providing compound and was used together with the dye-providing compound and the electron donor as the oil dispersion as in Example 1.

| | |
|---|---|
| Layer 6 Protective Layer | |
| Gelatin | 0.91 g/m² |
| Matting Agent (Silica) | 0.03 g/m² |
| Surface Active Agent (5) | 0.06 g/m² |
| Surface Active Agent (4) | 0.13 g/m² |
| Hardening Agent (9) | 0.01 g/m² |
| Base Precursor (13) | 0.30 g/m² |
| Layer 5 Blue-Sensitive Emulsion Layer | |

-continued

| | |
|---|---|
| Emulsion (III) | 0.30 g/m² as silver |
| Organic Silver Salt Emulsion | 0.25 g/m² |
| Gelatin | 1.00 g/m² |
| Antifoggant Precursor (14) | 0.07 g/m² |
| Yellow Dye-Providing Compound (1) | 0.50 g/m² |
| High-Boiling Organic Solvent (1) | 0.75 g/m² |
| Electron Donor (ED-12) | 0.35 g/m² |
| Surface Active Agent (7) | 0.05 g/m² |
| Electron Transfer Agent (X-5) | 0.04 g/m² |
| Thermal Solvent (15) | 0.20 g/m² |
| Hardening Agent (9) | 0.01 g/m² |
| Base Precursor (13) | 0.27 g/m² |
| Water-Soluble Polymer | 0.02 g/m² |
| Layer 4 Interlayer | |
| Gelatin | 0.75 g/m² |
| Reducing Agent (16) | 0.24 g/m² |
| Surface Active Agent (5) | 0.02 g/m² |
| Surface Active Agent (8) | 0.07 g/m² |
| Water-Soluble Polymer | 0.02 g/m² |
| Hardening Agent (9) | 0.01 g/m² |
| Base Precursor (13) | 0.25 g/m² |
| Layer 3 Green-Sensitive Emulsion Layer | |
| Emulsion (II) | 0.20 g/m² as silver |
| Organic Silver Salt Emulsion | 0.20 g/m² |
| Gelatin | 0.85 g/m² |
| Antifoggant Precursor (14) | 0.04 g/m² |
| Magenta Dye-Providing Compound (2) | 0.37 g/m² |
| High-Boiling Organic Solvent (1) | 0.55 g/m² |
| Electron Donor (ED-12) | 0.20 g/m² |
| Surface Active Agent (7) | 0.04 g/m² |
| Electron Transfer Agent (X-5) | 0.04 g/m² |
| Thermal Solvent (15) | 0.16 g/m² |
| Hardening Agent (9) | 0.01 g/m² |
| Base Precursor (13) | 0.25 g/m² |
| Water-Soluble Polymer | 0.02 g/m² |
| Layer 2 Interlayer | |
| Gelatin | 0.80 g/m² |
| Reducing Agent (16) | 0.24 g/m² |
| Surface Active Agent (5) | 0.06 g/m² |
| Surface Active Agent (8) | 0.10 g/m² |
| Water-Soluble Polymer | 0.03 g/m² |
| Base Precursor (13) | 0.25 g/m² |
| Hardening Agent (9) | 0.01 g/m² |
| Layer 1 Red-Sensitive Emulsion Layer | |
| Emulsion (I) | 0.20 g/m² as silver |
| Organic Silver Salt Emulsion | 0.20 g/m² |
| Gelatin | 0.85 g/m² |
| Antifoggant Precursor (14) | 0.04 g/m² |
| Thermal Solvent (15) | 0.16 g/m² |
| Base Precursor (13) | 0.25 g/m² |
| Cyan Dye-Providing Compound (3) | 0.40 g/m² |
| High-Boiling Solvent (1) | 0.60 g/m² |

-continued

| | |
|---|---|
| Electron Donor (ED-12) | 0.20 g/m$^2$ |
| Surface Active Agent (7) | 0.04 g/m$^2$ |
| Electron Transfer Agent (X-5) | 0.04 g/m$^2$ |
| Hardening Agent (9) | 0.01 g/m$^2$ |
| Water-Soluble Polymer | 0.02 g/m$^2$ |
| Support | |
| Polyethylene terephthalate film of 100 μm in thickness. | |
| Back Layer | |
| Carbon Black | 0.44 g/m$^2$ |
| Polyester | 0.30 g/m$^2$ |
| Polyvinyl Chloride | 0.30 g/m$^2$ |

The compounds used for the light-sensitive material were as follows.

Antifoggant Precursor (14):

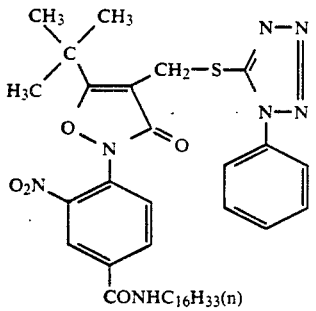

Thermal Solvent (15)
Benzenesufonamide

Base Precursor (13)
Guanigine 4-Chlorophenylosufonylacetate

Reducing Agent (16)

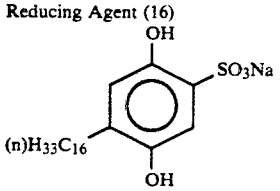

Then, a dye fixing material (R-2) was prepared as follows.

In 200 ml of water was dissolved 10 g of poly(methyl acrylate-co-N,N,N-trimethyl-N-vinylbenzylammonium chloride) (ratio of methyl acrylate to vinylbenzylammonium chloride 1:1) and the solution was uniformly mixed with 100 g of an aqueous solution of 10% lime-processed gelatin. After adding a hardening agent to the mixture, the mixture was uniformly coated in paper support coated with polyethylene having titianium dioxide dispersed therein at a wet thickness of 90 μm. The sample was dried and used as a dye-fixing material (R-2) having a mordant layer.

By following the same procedure as the case of preparing the light-sensitive material 201 except that each of the additives shown in Table 3 below was added, light-sensitive materials 202 to 207 were prepared.

TABLE 3

| Light-Sensitive Material | Additive | | Added Layer and added amount (mg/m$^2$) Layer 1 | Layer 2 | Layer 3 | Layer 4 | Layer 5 | Layer 6 |
|---|---|---|---|---|---|---|---|---|
| 201 | — | (Comparison) | — | — | — | — | — | — |
| 202 | (1) | (Comparison) | 0.06 | — | 0.06 | — | 0.06 | — |
| 203 | " | " | — | 0.06 | — | 0.06 | — | 0.06 |
| 204 | ES-4 | (Invention) | 0.06 | — | 0.06 | — | 0.06 | — |
| 205 | " | " | — | 0.06 | — | 0.06 | — | 0.06 |
| 206 | ES-89 | (Invention) | 0.08 | — | 0.08 | — | 0.08 | — |
| 207 | " | " | — | — | — | 0.24 | — | — |

After exposing each of the light-sensitive materials thus prepared by the same manner as in Example 1, the light-sensitive material was uniformly heated on a heat block heated to 140° C. for 30 seconds.

After supplying 20 ml/m$^2$ of water to the layer surface side of the dye-fixing material (R-2), the aforesaid light-sensitive material thus heated was superposed to the dye-fixing material such that the layers were in contact relation with each other.

Then, after passing the assembly through a laminator heated to 80° C. at a line speed of 12 mm/sec., the dye-fixing material was separated from the light-sensitive material. In each case, positive images having good discrimination were obtained on the dye-fixing material.

The results of measuring Dmax and Dmin of each of cyan, magenta, and yellow at the gray portion are shown in Table 4 below.

TABLE 4

| Light-Sensitive Material | Additive | | Dmax Cyan | Magenta | Yellow | Dmin Cyan | Magenta | Yellow |
|---|---|---|---|---|---|---|---|---|
| 201 | — | (Comparison) | 2.05 | 2.13 | 1.95 | 0.17 | 0.21 | 0.22 |
| 202 | (1) | " | 2.05 | 2.13 | 1.96 | 0.17 | 0.21 | 0.22 |
| 203 | " | " | 2.07 | 2.12 | 1.95 | 0.17 | 0.21 | 0.22 |
| 204 | ES-4 | (Invention) | 2.06 | 2.14 | 1.96 | 0.16 | 0.20 | 0.20 |
| 205 | " | " | 2.05 | 2.13 | 1.96 | 0.16 | 0.20 | 0.20 |
| 206 | ES-82 | " | 2.07 | 2.12 | 1.96 | 0.16 | 0.19 | 0.20 |
| 207 | " | " | 2.06 | 2.12 | 1.96 | 0.16 | 0.20 | 0.21 |

While the invention has been described in detail and with reference to specific embodiments thereof, it will be apparent to one skilled in the art that various changes and modifications can be made therein without departing from the spirit and scope thereof.

What is claimed is:

1. A heat-developable color photographic light-sensitive material comprising at least a light-sensitive silver halide, a binder, a dye-providing non-diffusible compound capable of releasing a diffusible dye on being reduced, and a reducing agent, wherein said light-sensitive material further contains at least one compound represented by following formula (I), (II), or (III);

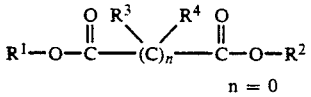

(I)

n = 0

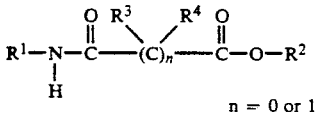

(II)

n = 0 or 1

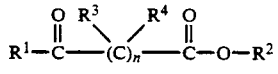

(III)

n = 0 or 1 wherein $R^1$ and $R^2$ each represents a substituted or unsubstituted alkyl group, a substituted or unsubstituted aryl group, or a substituted or unsubstituted heterocyclic group, with a proviso that $R^1$ and $R^2$ each represents a group having no redox activity after its cleavage and $R^3$ and $R^4$ each represents a hydrogen atom, a halogen atom, a substituted or unsubstituted alkyl group, a substituted or unsubstituted aryl group, or a substituted or unsubstituted heterocyclic group.

2. A heat-developable color photographic light-sensitive material as in claim 1, wherein $R^1$ and $R^2$ in formulae (I), (II) and (III) each independently represents a substituted or unsubstituted alkyl group having from 1 to 40 carbon atoms, a substituted or unsubstituted aryl group having not more than 40 carbon atoms or a substituted or unsubstituted heterocyclic group having not more than 40 carbon atoms.

3. A heat-developable color photographic light-sensitive material as in claim 1, wherein $R^1$ and $R^2$ in formulae (I), (II) and (III) each independently represents a group selected from the group consisting of methyl, ethyl, propyl, i-propyl, n-butyl, i-butyl, t-butyl, n-hexyl, cyclohexyl, n-octyl, n-decyl, n-dodecyl, n-hexadecyl, 2-ethylhexyl, decalyl, benzyl, alkylbenzyl, alkoxybenzyl, hydroxyethyl, acyloxyethyl, alkoxyethyl, phenyl, tolyl, xylyl, cumyl, anisyl, nitrophenyl, sulfophenyl, alkoxyphenyl, chlorophenyl, bromophenyl, pyridyl, furyl, thiophenyl, imidazolyl, alkylpyridyl, and quinolyl, each of which may be substituted or unsubstituted.

4. A heat-developable color photographic light-sensitive material as in claim 1, wherein $R^3$ and $R^4$ each independently represents a hydrogen atom, a halogen atom, a substituted or unsubstituted alkyl group, a substituted or unsubstituted aryl group, or a substituted or unsubstituted heterocyclic group, each group having not more than 20 carbon atoms.

5. A heat-developable color photographic light-sensitive material as in claim 1, wherein $R^3$ and $R^4$ in formulae (I), (II) and (III) each independently represents a group selected from the group consisting of methyl, ethyl, propyl, i-propyl, n-butyl, i-butyl, t-butyl, n hexyl, cyclohexyl, n-octyl, n-decyl, n-dodecyl, n-hexadecyl, 2-ethylhexyl, decalyl, benzyl, alkylbenzyl, alkoxybenzyl, hydroxyethyl, acyloxyethyl, alkoxyethyl, phenyl, tolyl, xylyl, cumyl, anisyl, nitrophenyl, sulfophenyl, alkoxyphenyl, chlorophenyl, bromophenyl, pyridyl, furyl, thiophenyl, imidazolyl, alkylpyridyl, and quinolyl, each of which may be substituted or unsubstituted.

6. A heat-developable color photographic light-sensitive material as in claim 1, wherein the compound represented by formula (I), (II) or (III) is incorporated in the color photographic light-sensitive material in an amount of from 0.01 to 10 mole times the total amount of the reducing agent.

7. A heat-developable color photographic light-sensitive material as in claim 1, wherein the compound represented by formula (I), (II) or (III) is incorporated in the color photographic light-sensitive material in an amount of from 0.05 to 2 mole times the total amount of the reducing agent.

8. A heat-developable color photographic light-sensitive material as in claim 1, wherein said light-sensitive material comprises an electron donor and an electron transfer agent (ETA) or precursor thereof, wherein the ETA or the precursors thereof are present, in a total amount of from 0.01 to 50 moles per mole of the dye-providing compound and from 0.001 to 5 moles per mole of silver halide.

9. A heat-developable color photographic light-sensitive material as in claim 1, wherein the compound is incorporated into light-sensitive layer(s), intermediate layer(s), or a protective layer of the light-sensitive material.

10. A heat-developable color photographic light-sensitive material as in claim 1, wherein said light-sensitive material comprises at least two units of light-sensitive layers each layer of which is composed of a combination of the reducible dye-providing compound, an electron transfer agent, an electron donor, a binder and a silver halide emulsion.

11. A heat-developable color photographic light-sensitive material as in claim 1, wherein said at least one compound represented by formula (I) or (II) is coemulsified with at least one of the dye providing non-diffusible compound and an electron donor.

12. A heat-developable color photographic light-sensitive material as in claim 1, wherein said reducing agent is at least one of an electron donor and a precursor thereof.

* * * * *